US008992388B2

(12) United States Patent
Beckwith et al.

(10) Patent No.: US 8,992,388 B2
(45) Date of Patent: Mar. 31, 2015

(54) MODULAR LADDER FRAME PLAYGROUND SYSTEM

(75) Inventors: Jay Beckwith, Healdsburg, CA (US); Hap Parker, Turnwater, WA (US)

(73) Assignee: Gym-Mark, Inc., San Francisco, CA (US)

( * ) Notice: Subject to any disclaimer, the term of this patent is extended or adjusted under 35 U.S.C. 154(b) by 171 days.

(21) Appl. No.: 13/492,365

(22) Filed: Jun. 8, 2012

(65) Prior Publication Data

US 2012/0316038 A1 Dec. 13, 2012

Related U.S. Application Data

(60) Provisional application No. 61/495,770, filed on Jun. 10, 2011, provisional application No. 61/548,162, filed on Oct. 17, 2011.

(51) Int. Cl.

| | |
|---|---|
| ***A63B 9/00*** | (2006.01) |
| ***A63B 17/00*** | (2006.01) |
| ***E04G 1/00*** | (2006.01) |
| ***E04G 1/15*** | (2006.01) |
| ***E04G 3/00*** | (2006.01) |
| ***E04G 5/08*** | (2006.01) |
| ***E04G 7/16*** | (2006.01) |
| ***A63G 31/00*** | (2006.01) |
| ***E04H 3/14*** | (2006.01) |
| ***A63G 21/00*** | (2006.01) |

(52) U.S. Cl.

CPC ..... *A63G 21/00* (2013.01); *A63G 31/00* (2013.01); *A63B 2208/12* (2013.01); *A63B 2009/006* (2013.01)

USPC ..... 482/35; 182/179.1; 182/222; 482/36; 472/136

(58) Field of Classification Search

CPC ..... A63B 17/04; A63B 3/00; A63B 9/00; A63B 17/00; A01K 15/00; A63H 33/08

USPC ..... 482/23, 35, 36, 33, 34, 37, 908; 118/222, 179.1, 178.1; 472/116, 117, 472/136

See application file for complete search history.

(56) References Cited

U.S. PATENT DOCUMENTS

| | | | | | |
|---|---|---|---|---|---|
| 1,708,883 | A | * | 4/1929 | Hedges | 482/36 |
| 1,765,361 | A | * | 6/1930 | Berman | 482/36 |
| 2,206,581 | A | * | 7/1940 | Shapiro | 482/36 |
| 3,011,586 | A | * | 12/1961 | Harvey, Jr. | 182/115 |
| 3,565,212 | A | | 2/1971 | Johnson | |
| 3,572,698 | A | * | 3/1971 | Greenly | 482/36 |
| 3,719,358 | A | | 3/1973 | Aaron | |
| 3,814,416 | A | * | 6/1974 | Munger et al. | 482/36 |
| 3,897,055 | A | * | 7/1975 | Caldow | 482/36 |
| 4,240,522 | A | | 12/1980 | Shawkey et al. | |

(Continued)

FOREIGN PATENT DOCUMENTS

| | | |
|---|---|---|
| CN | 20108001318.0 | 4/2014 |
| EP | 2 256 355 A1 | 12/2010 |

*Primary Examiner* — Oren Ginsberg
*Assistant Examiner* — Gary D Urbiel Goldner
(74) *Attorney, Agent, or Firm* — Orrick, Herrington & Sutcliffe, LLP

(57) ABSTRACT

The present invention relates to playground equipment and, more particularly, to a playground apparatus incorporating modular construction, which permits rapid simplified assembly, modification and universal arrangement of playground equipment modules without tools.

14 Claims, 31 Drawing Sheets

(56) References Cited

U.S. PATENT DOCUMENTS

| | | | | |
|---|---|---|---|---|
| 4,291,784 | A | 9/1981 | Moses | |
| 4,497,279 | A | 2/1985 | Bell | |
| 5,326,337 | A | 7/1994 | Pardella | |
| 5,356,354 | A * | 10/1994 | Owens | 482/35 |
| 5,409,122 | A * | 4/1995 | Lazarus | 211/186 |
| 5,695,081 | A * | 12/1997 | Alkalay | 211/187 |
| 2007/0087154 | A1 | 4/2007 | Bird et al. | |
| 2009/0176622 | A1 * | 7/2009 | Pizmony | 482/35 |
| 2012/0180408 | A1 * | 7/2012 | Harris et al. | 52/177 |

* cited by examiner

MODULAR LADDER FRAME PLAYGROUND SYSTEM

CROSS-REFERENCE TO RELATED APPLICATIONS

This application claims the benefit of U.S. Provisional Application Ser. No. 61/495,770, entitled "Modular Ladder Frame Playground System," filed on Jun. 10, 2011, and U.S. Provisional Application Ser. No. 61/548,162, entitled "Modular Ladder Frame Playground System," filed Oct. 17, 2011, which applications are incorporated herein by reference.

FIELD

The present invention relates to playground equipment and, more particularly, to a playground apparatus incorporating modular construction, which permits rapid simplified assembly, modification and universal arrangement of playground equipment modules without tools.

BACKGROUND

In the past, playground equipment typically consisted of a single-unit device such as a slide, a swing, a set of swinging bars or the like. These components were sometimes permanently combined during manufacture. Modern playground equipment, however, has become a conglomeration of many playground components or modules attached to one another by various means and in a variety of arrangements. These changes in playground equipment have evolved to meet the demands of a new generation of child-care facilities. In the past, most playground equipment was found in large schoolyards where space was plentiful and basic equipment was sufficient. However, with the ever-increasing number of day-care facilities, play centers for learning and training of children and many other child-care facilities, the requirements for playground equipment to meet a great variety of needs have created a dilemma for the producers of the equipment.

For example, if a user is providing equipment for use in play and learning classes for children of various ages and abilities, such as the Gymboree® Play & Music® program, that involve age-appropriate activities, this would involve a mix of equipment, play and activities on mats. One of the more demanding aspects of the Gymboree® programs is the requirement to adapt the activity area for the next age group in the 5-10 minutes that are available between sessions. As in many child-care and learning facilities, the space requirements vary. While one facility with a large playground to accommodate large numbers of children may require equipment having several varied components, another smaller operation may have limited space, which requires the equipment to be limited to only one or a small number of components that must be specifically arranged to fit the available space.

While any playground equipment having a variety of components may obviously be assembled and disassembled, the equipment available prior to this disclosure relies on concrete footings and connecting devices that are rendered permanent by a variety of means and does not lend itself to be quickly and easily assembled and custom configured to meet the varied needs of the present generation of equipment users. Specifically fixed playground equipment does not allow for continuous adaptations to the play environment to accommodate children of various ages and abilities or to alter the play setting to provide additional challenge in consideration of the learning that children experience during use of the equipment. Thus, there is a need for a safe and sturdy modular playground system with a small number of module assembly mechanisms to which all playground modules may be attached that permits simplified transportation, assembly and modification of unattached playground modules of varied types without tools.

This unique design for a Ladder with Fixed and Removable Rungs is part of a system of components that may be fitted together to form a variety of arrangements, and when further combined with other special platforms, barriers, and climbing-activity components to name a few, are intended to inspire fitness activity and physical development in young children and those arrangements of components further perform that in ways that also serve to enhance cognitive and social developmental realms in the children who use the overall play equipment. This Ladder with Removable Rungs may also be used in other combinations to form additional structures and structural systems for other purposes than play. This Ladder with Removable Rungs has as a basic characteristic, a method included in its design that allows some of the horizontal rung components to be removed and repositioned by persons when in the process of reconfiguring the physical arrangement of the overall structure, of which this ladder is a key component. This process may be accomplished without the use of tools, only requiring the hands to fit and secure the components in place, or, conversely, to disassemble the components for reconfiguration or storage.

SUMMARY

The disclosure describes a unique modular construction apparatus that greatly enhances the building, efficient transportation, assembly and utility of modern playground equipment. More specifically, the disclosure provides a unique nucleus around which a modular construction of playground equipment may be quickly and easily assembled. This nucleus is defined as a modular ladder frame assembly. This mechanism comprises three or more modular ladder frames, a lockable deck and a plurality of connectors. The modular ladder frame assembly is connected to one or more brace mechanisms. The system is constructed of three or more modular ladder frames connected at the ends by a plurality of connectors thereof so as to form a configuration for attachment thereto of a lockable deck, and subsequently, the brace mechanisms. As will be seen in more detail as the description continues, the modular ladder frame playground system is specifically designed for quick and easy assembly of a variety of brace mechanisms that comprise playground equipment modules, such as stairways, ladders, slides, fish-eye windows, safety rails, game devices, tunnels, walkways and the like. Other systems, methods, features and advantages of the example embodiments will be or will become apparent to one with skill in the art upon examination of the following figures and detailed description.

DETAILED DESCRIPTION

Figure 1:
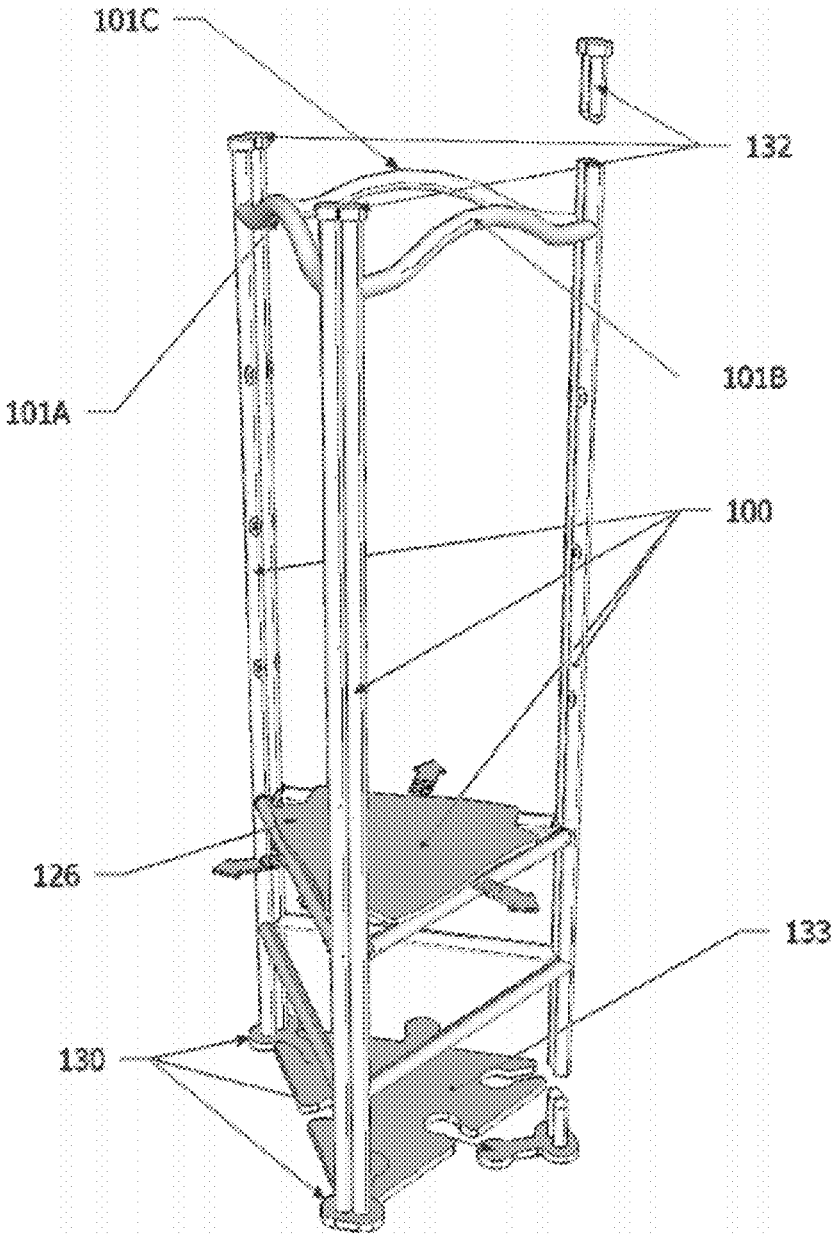
FIG. 1 is a perspective view of a modular ladder frame assembly mechanism.

The purpose of this system disclosed is to create a modular ladder frame playground system that is stable and can be reconfigured extremely rapidly without tools. The core of the modular ladder frame playground system is a modular ladder frame assembly mechanism 100. FIG. 1 is a perspective view of a modular ladder frame assembly mechanism 100. FIG. 1 illustrates one embodiment of the modular frame assembly 100 that comprises three or more modular ladder frames 101A, 101B and 101C, a plurality of connectors 130 and 132, floor puzzle 133 and a lockable deck 126. Three or more modular ladder frames 101A, 101B and 101C are connected at the top and bottom by a plurality of connectors 130 and 132. A lockable deck 126 is inserted between these modular ladder frames, which, by virtue of having rubber cleats or other spring-like elements on its edges, forces the top and bottom connections to lock into place (not shown in FIG. 1). The lockable deck 126 also aligns the modular ladder frames 101A, 101B and 101C into a regular configuration as shown in FIG. 1, which, in this embodiment, is a triangular configuration. The regular configuration of the modular ladder frame assembly may be any geometric shape, including, but not limited to, triangular, rectangular, square, octagonal and the like. The addition of nonskid flooring beneath the modular frame ladder playground system provides additional stabilization.

Figure 2:
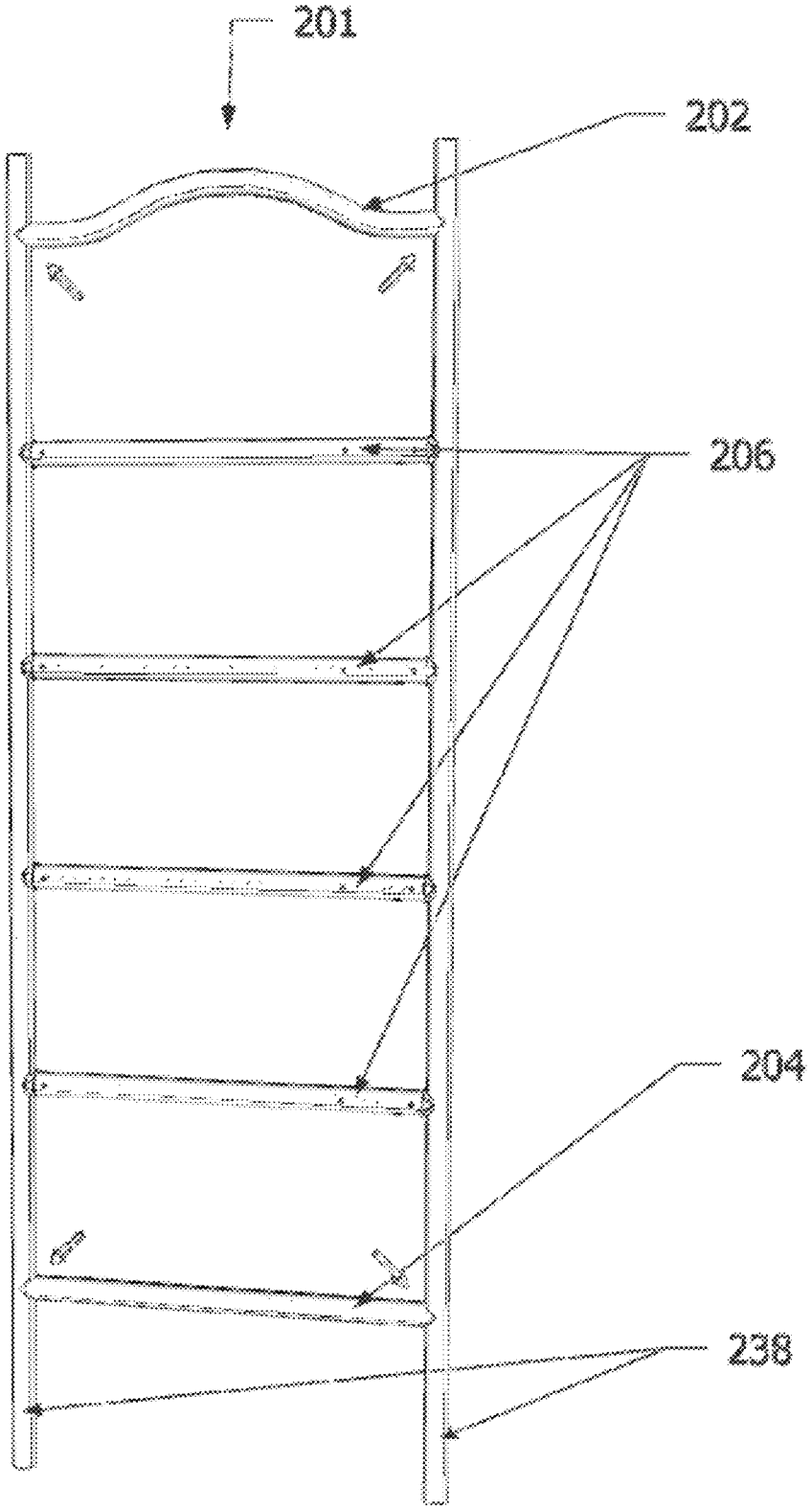
FIG. 2 is a perspective view of a modular ladder frame with removable rungs and nonremovable rungs.

FIG. 2 is a perspective view of a modular ladder frame 201 with removable rungs 206 and nonremovable rungs 202 and 204. The modular ladder frames 201 themselves can be configured in many ways, the primary requirement being providing rungs 202, 204 and 206 on which a lockable deck(s) (not shown) can be placed to provide the locking force necessary to stabilize the system. In the example shown in FIG. 2, nonremovable or permanent rungs 202 and 204 are combined with removable rungs 206 to better accommodate users moving over and through the system when complex configurations are created. The modular ladder frames 201 comprise vertical supports 238 that run through the length of the modular ladder frames 201. Structurally, it is only necessary that the rungs be of sufficient number and rigidity to impart sufficient integrity to the modular frame assembly for the anticipated loads.

Figure 3:
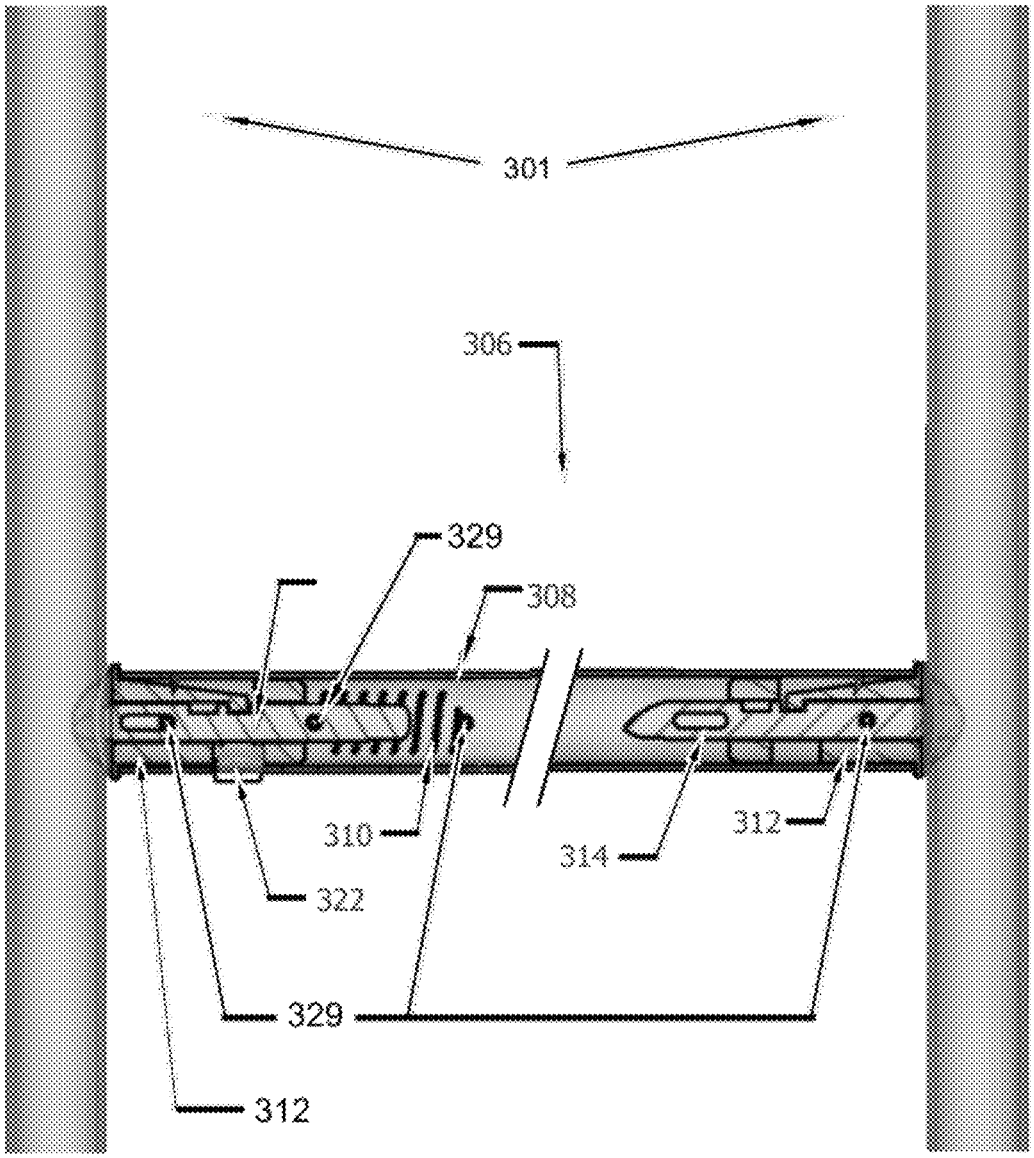
FIG. 3 is a cross-sectional view of the removable rungs of the modular ladder frame.

FIG. 3 is a cross-sectional view of the removable rungs 306 of the modular ladder frame 301. The cross section of the removable rungs 306 of the modular ladder frame 301 comprises tubular pipe casing 308, index button 322, a compression spring 310, Sleevie Wonder 312, Latch Bar 314, Pins 329, which secure the Sleevie Wonder in the tubular pipe casing 308 and which retain the compression spring 310. The components of removable rung 306 interact to allow for the secure placement and removal of the removable rung 306 from the modular ladder frame 301 to accommodate the use of the playground system for various sizes and ages of children.

Figure 4:
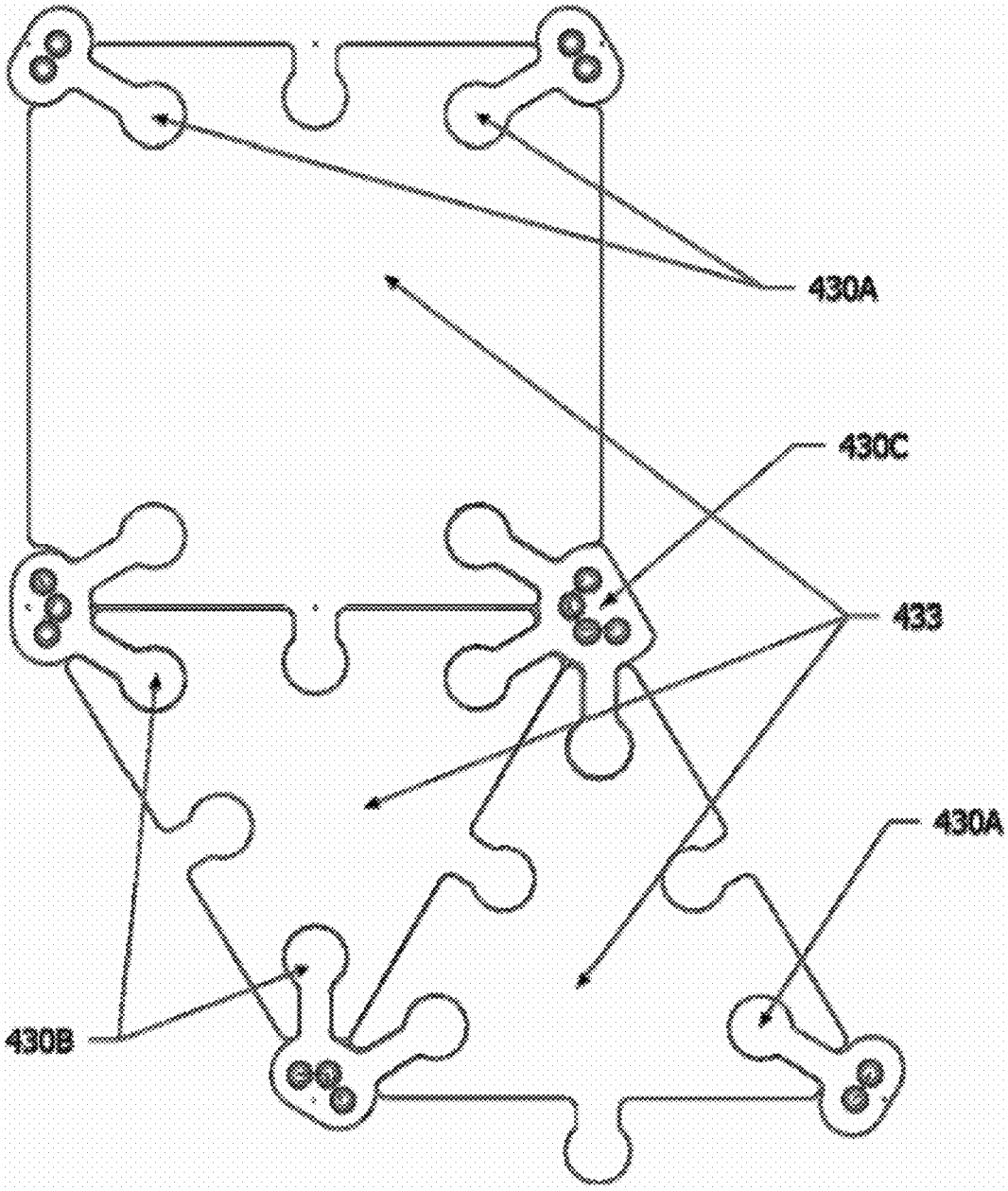
FIG. 4 is a detailed perspective view of a floor puzzle of the modular frame playground system, as shown in FIG. 1.

FIG. 4 is a perspective view of the floor puzzle 433 that is associated with the horizontal support of the modular ladder playground system. The floor puzzle 433 is placed on the floor either as one unit or multiple connecting units. The floor puzzle 433 in FIG. 4 illustrates a three unit configuration. The floor puzzle 433 functions to receive the base connectors as shown in FIG. 7, two aperture base connectors 430A, three aperture base connectors 430B, and four aperture base connectors 430C. The floor puzzle 433 along with the base connectors serve to support the modular ladder playground system as shown in FIG. 1, FIG. 9B, FIG. 9C and FIG. 11.

Figure 5:
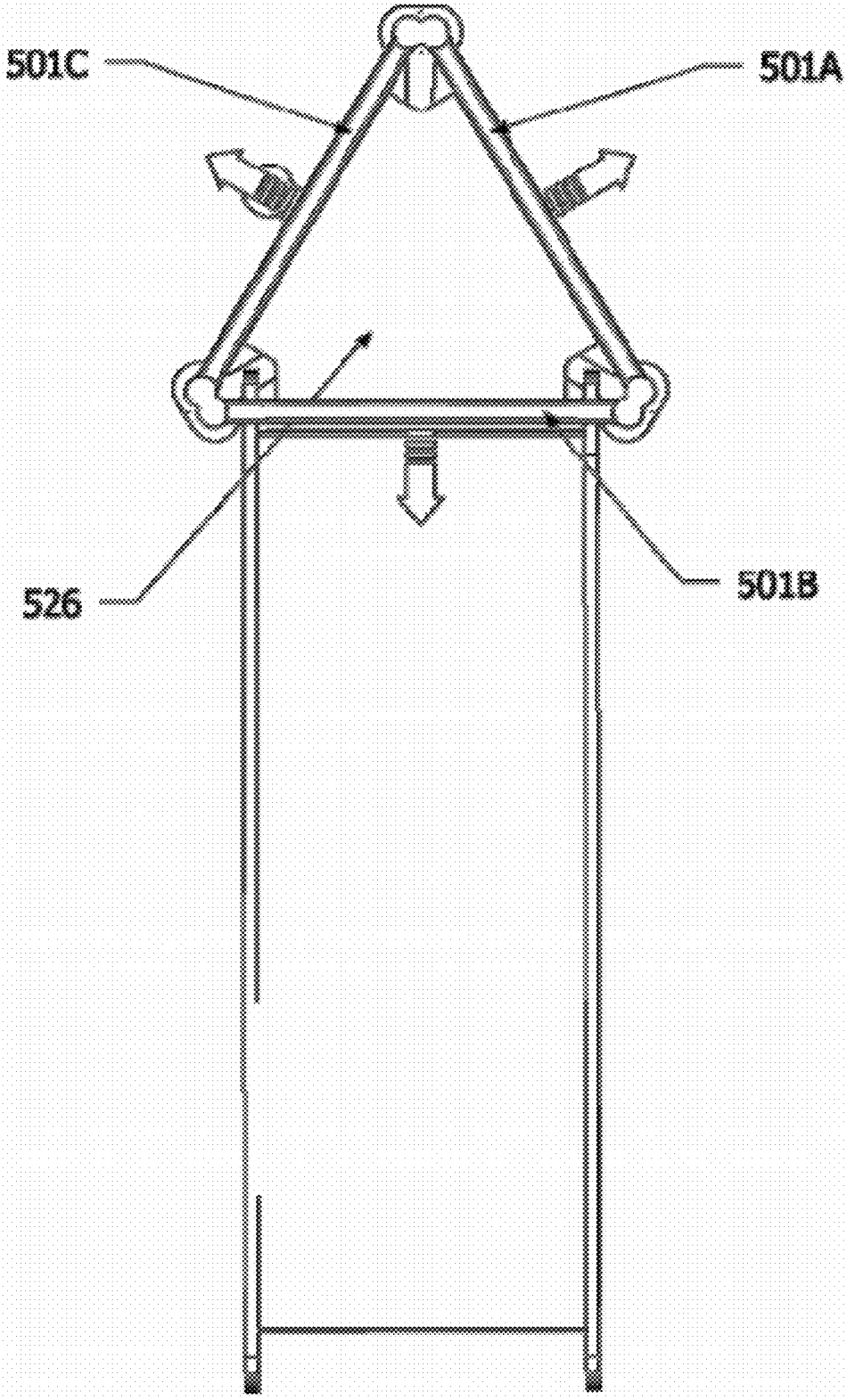
FIG. 5 is a perspective view of the lockable deck of the modular ladder frame assembly.

FIG. 5 is a perspective view of the lockable deck 526 of the modular ladder frame assembly. A lockable deck 526 is inserted between these modular ladder frames, which, by virtue of having rubber cleats or other spring-like elements on its edges, forces the top and bottom connections to lock into place (not shown in FIG. 5). The lockable deck 526 also aligns the modular ladder frames 501A, 501B and 501C into a regular configuration as shown in FIG. 1.

Figure 6A:
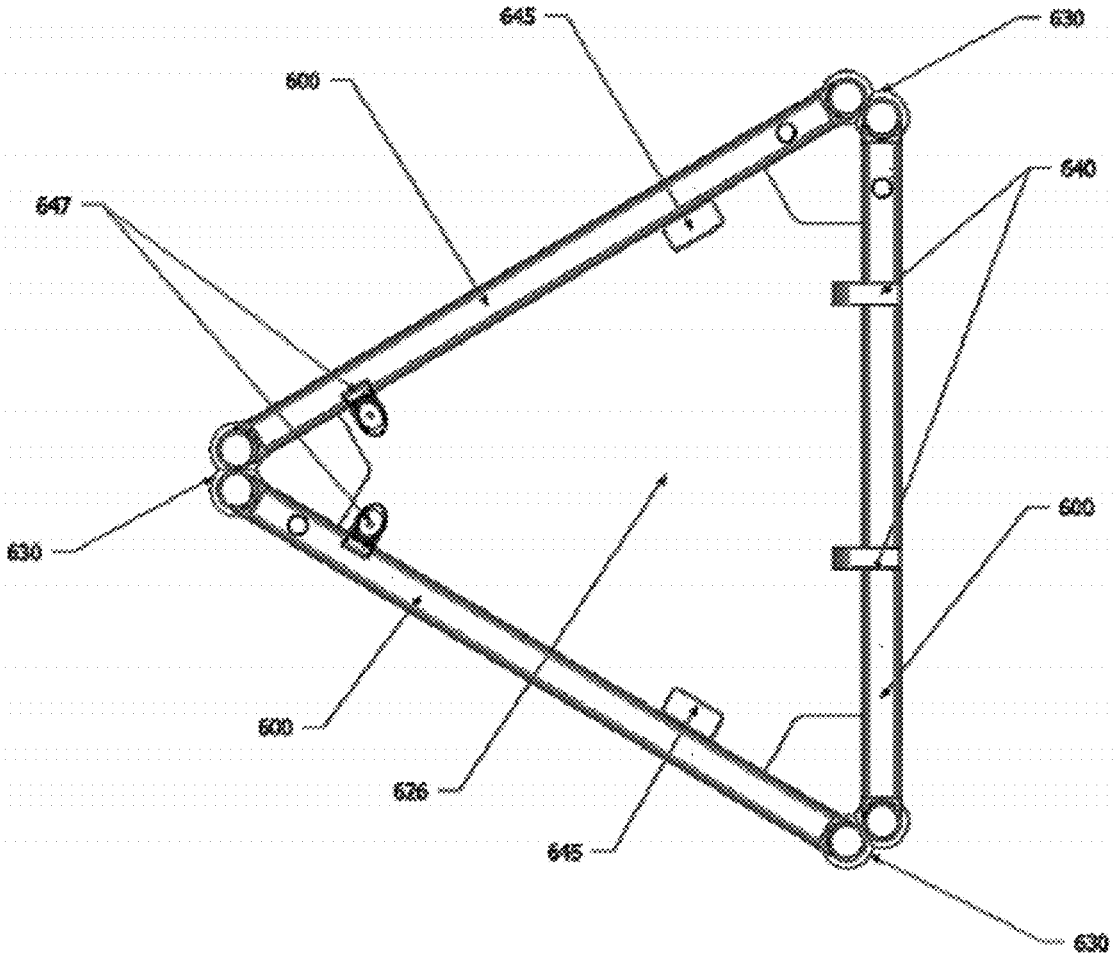
FIGS. 6A to 6E are detailed views of the lockable deck of the modular ladder frame assembly.

FIG. 6A a detailed view of the underside of the lockable deck 626 of the modular ladder frame assembly (not shown). The detailed view of the lockable deck 626 illustrates the hook 640 and the top connectors 630 of the modular frame assembly 600, that are shown and discussed in more detail in FIG. 8A to FIG. 8E below. The sides of the lockable deck 626 connect to the modular frame by lockable deck latch 647, hook 640 and cleats 645 that securely and snugly fit onto and/or against the rungs of the modular ladder frame assembly. A lockable deck 626 is inserted between these modular ladder frames, which, by virtue of having a latch 647 or other spring-like elements on its edges, forces the top and bottom connections to lock into place as shown in FIG. 6. One skilled in the art understands that the latch 647 can be any type of element or mechanism that forces the secure connection of the lockable deck 626 into place on the modular frame assembly. The hooks 640 allow for a better fit to the modular frame.

Figure 6B:
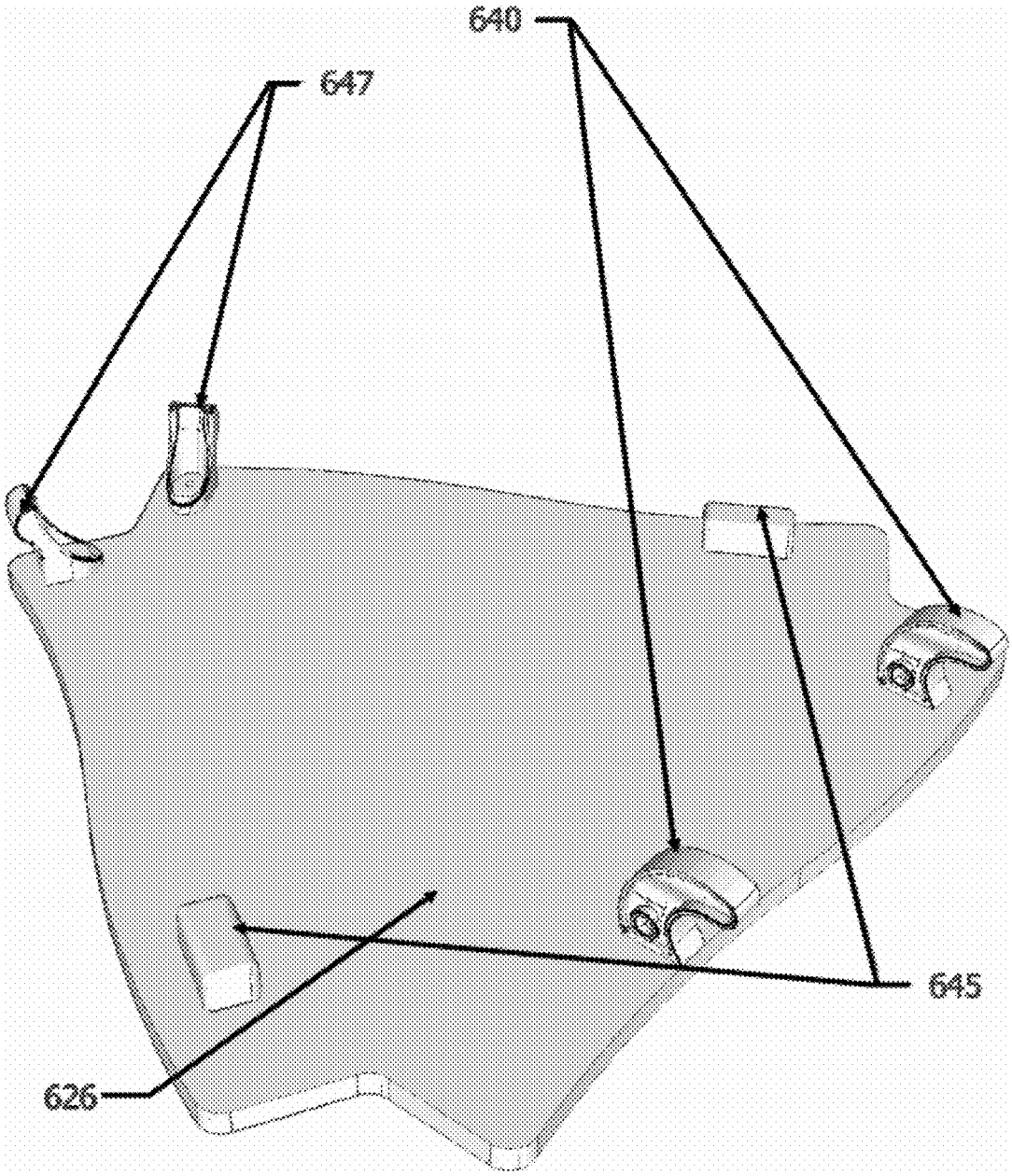
Figure 6C:
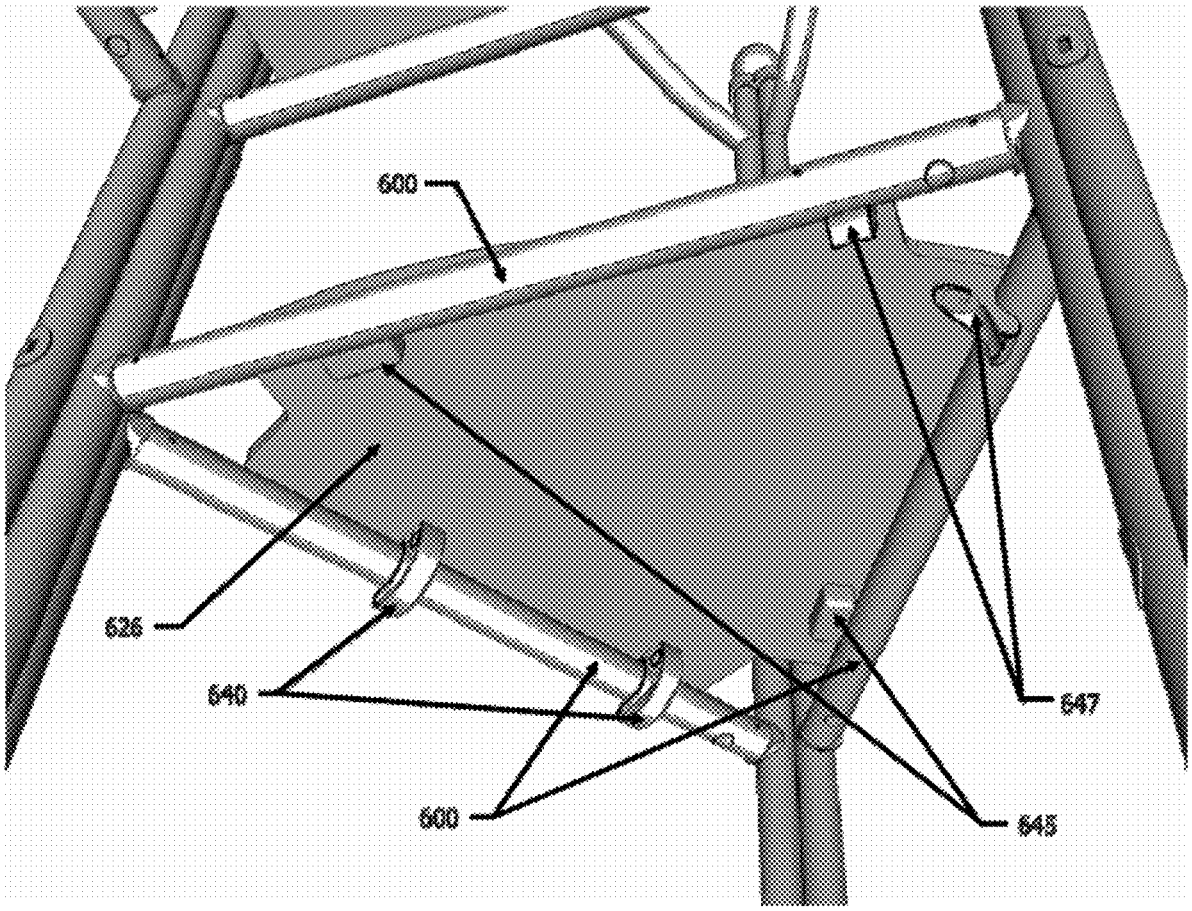

FIG. 6B is a 3-D perspective view of the bottom of the lockable deck 626 of the modular ladder frame assembly (not shown). FIG. 6C is a 3-D perspective view of the bottom of the lockable deck 626 that is attached to the modular ladder frame assembly 600. The embodiments of the lockable deck in FIG. 6B and FIG. 6C have a triangular shape. The sides of the lockable deck 626 connect to the modular frame by lockable deck latch 647 that snugly fit onto or against the modular ladder frame assembly 600 at the sides of the lockable deck 626. A lockable deck 626 is inserted between these modular ladder frames, which, by virtue of having lockable deck latches 647 or other spring-like elements on its edges, force the cleats 645 and hooks 640 to lock into place as shown in FIG. 6C. One skilled in the art understands that the lockable deck latches 647 can be any type of element or mechanism that forces the secure connection of the lockable deck 626 into place on the modular frame assembly.

Figure 6D:
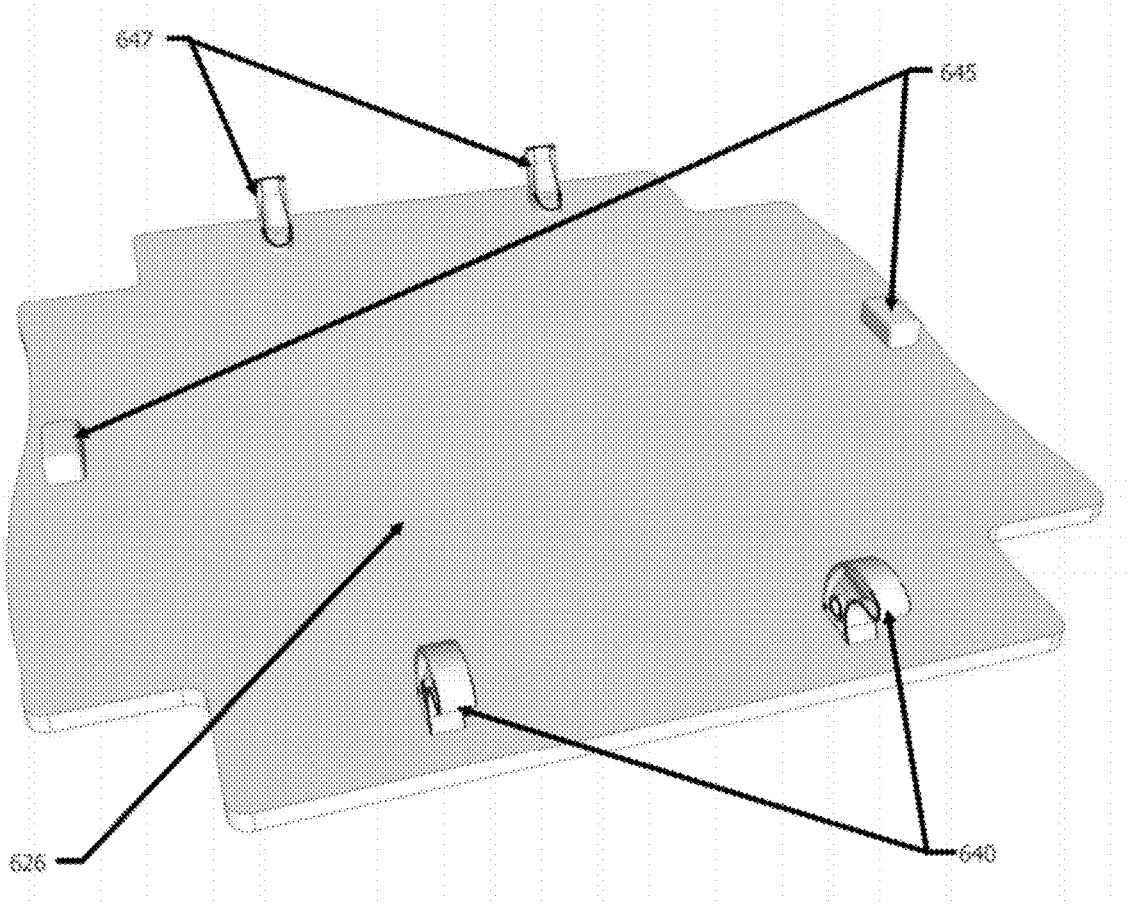
Figure 6E:
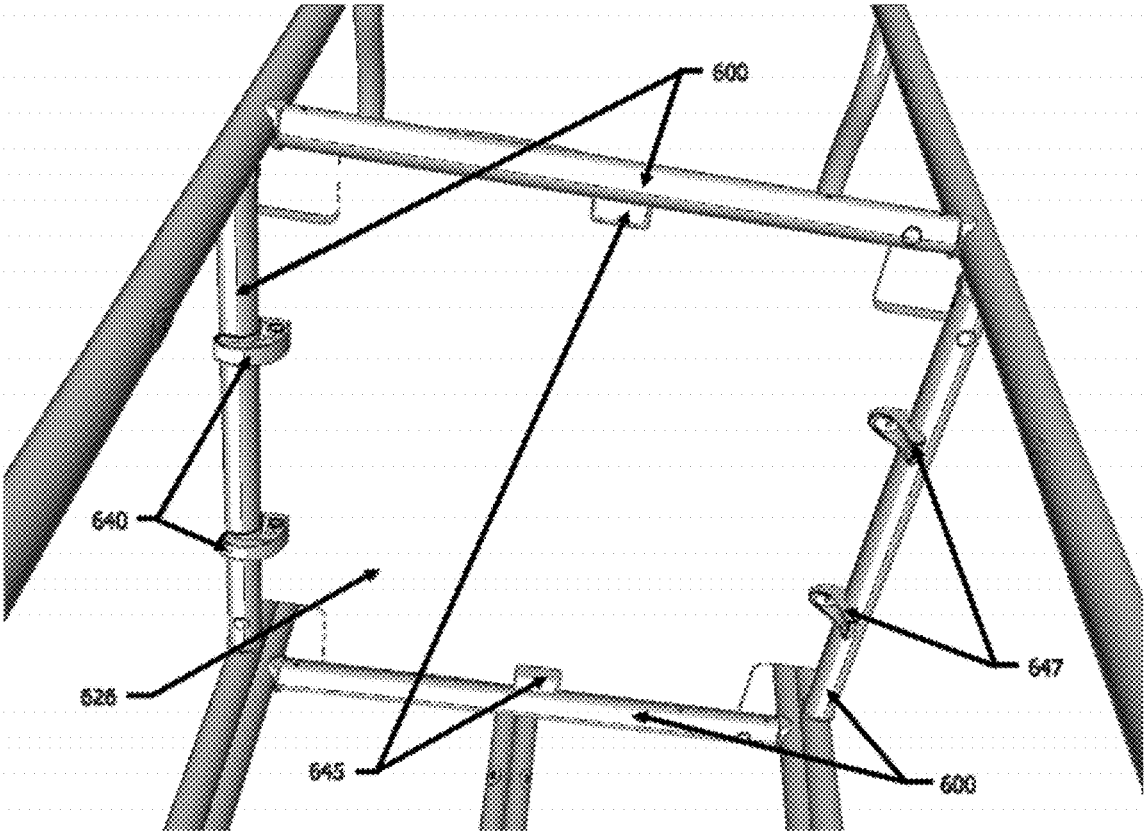

FIG. 6D is a 3-D perspective view of the bottom of the lockable deck 626 of the modular ladder frame assembly (not shown). FIG. 6E is a 3-D perspective view of the bottom of the lockable deck 626 that is attached to the modular ladder frame assembly 600. The embodiments of the lockable deck in FIG. 6D and FIG. 6E have a cross or square shape. The sides of the lockable deck 626 connect to the modular frame by lockable deck latches 647 that snugly fit onto or against the modular ladder frame assembly 600 at the sides of the lockable deck 626. A lockable deck 626 is inserted between these modular ladder frames, which, by virtue of having hooks 640 and lockable deck latches 647 or other spring-like elements on its edges, force the hooks 640, cleats 645 and lockable deck latches 647 to lock into place as shown in FIG. 6C. One skilled in the art understands that the lockable deck latches 647 can be any type of element or mechanism that forces the secure connection of the lockable deck 626 into place on the modular frame assembly.

Figure 7A:
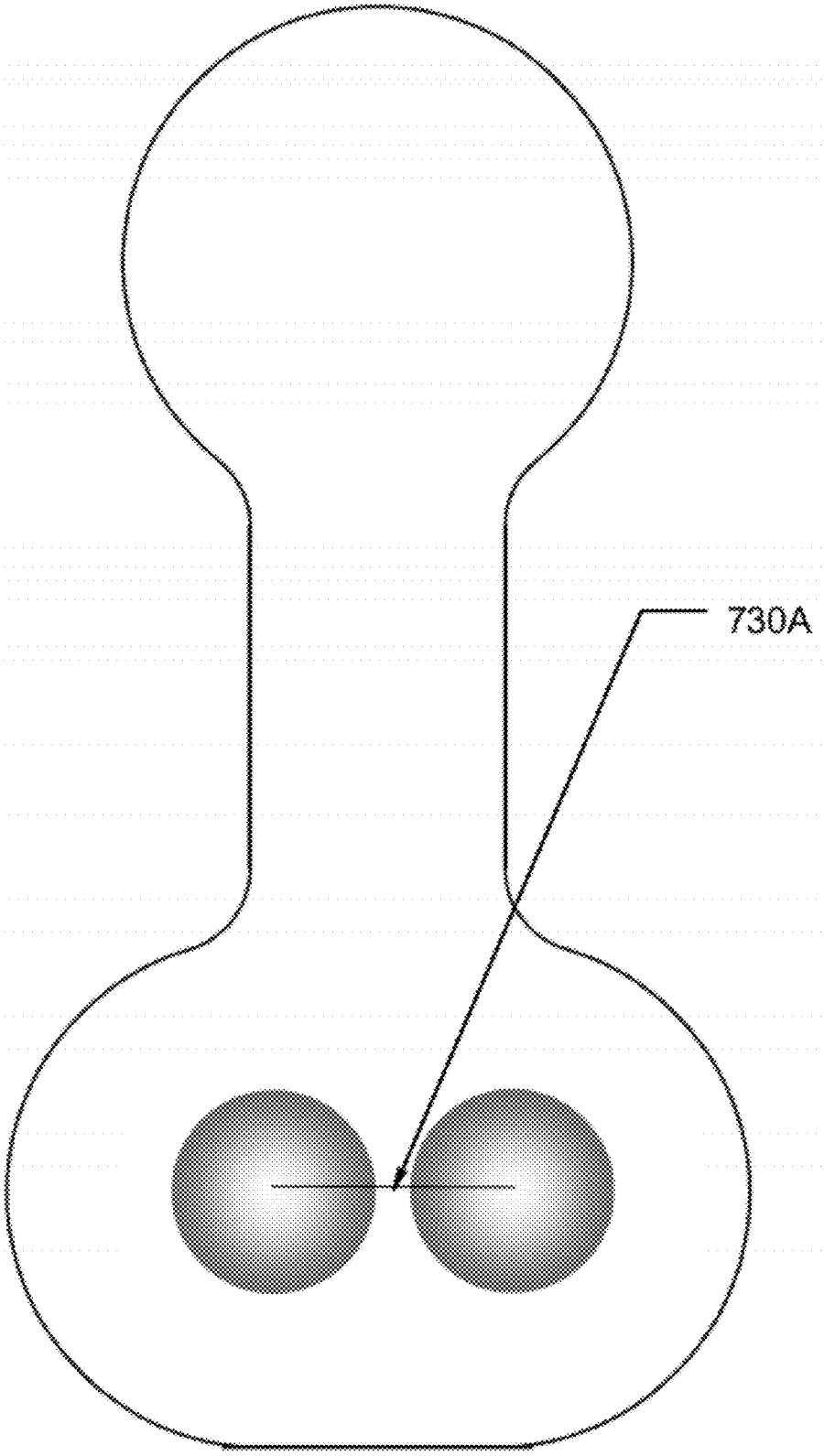
FIGS. 7A to 7E are cross-sectional views of the base connectors of the modular ladder frame assembly.
Figure 7B:
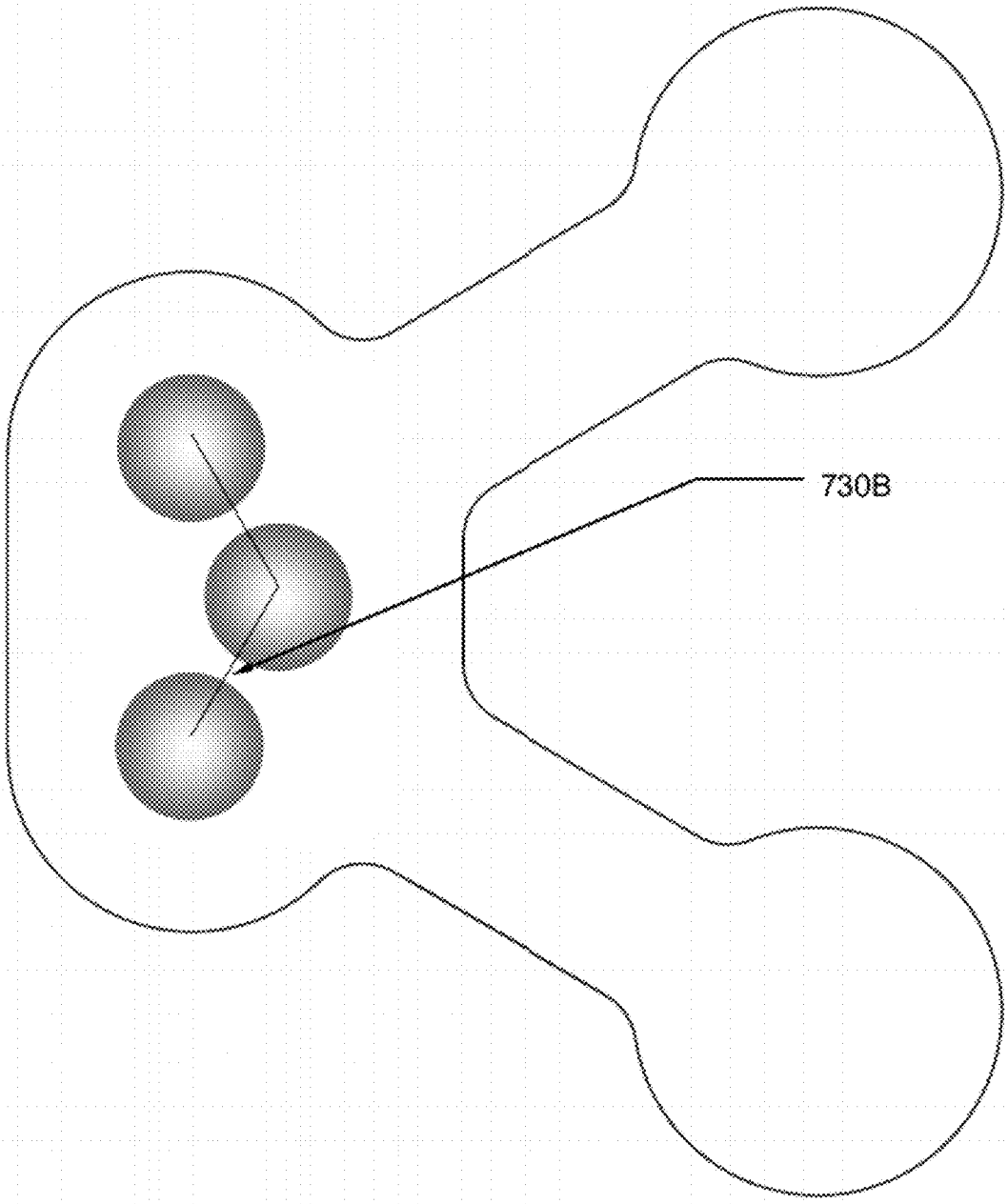
Figure 7C:
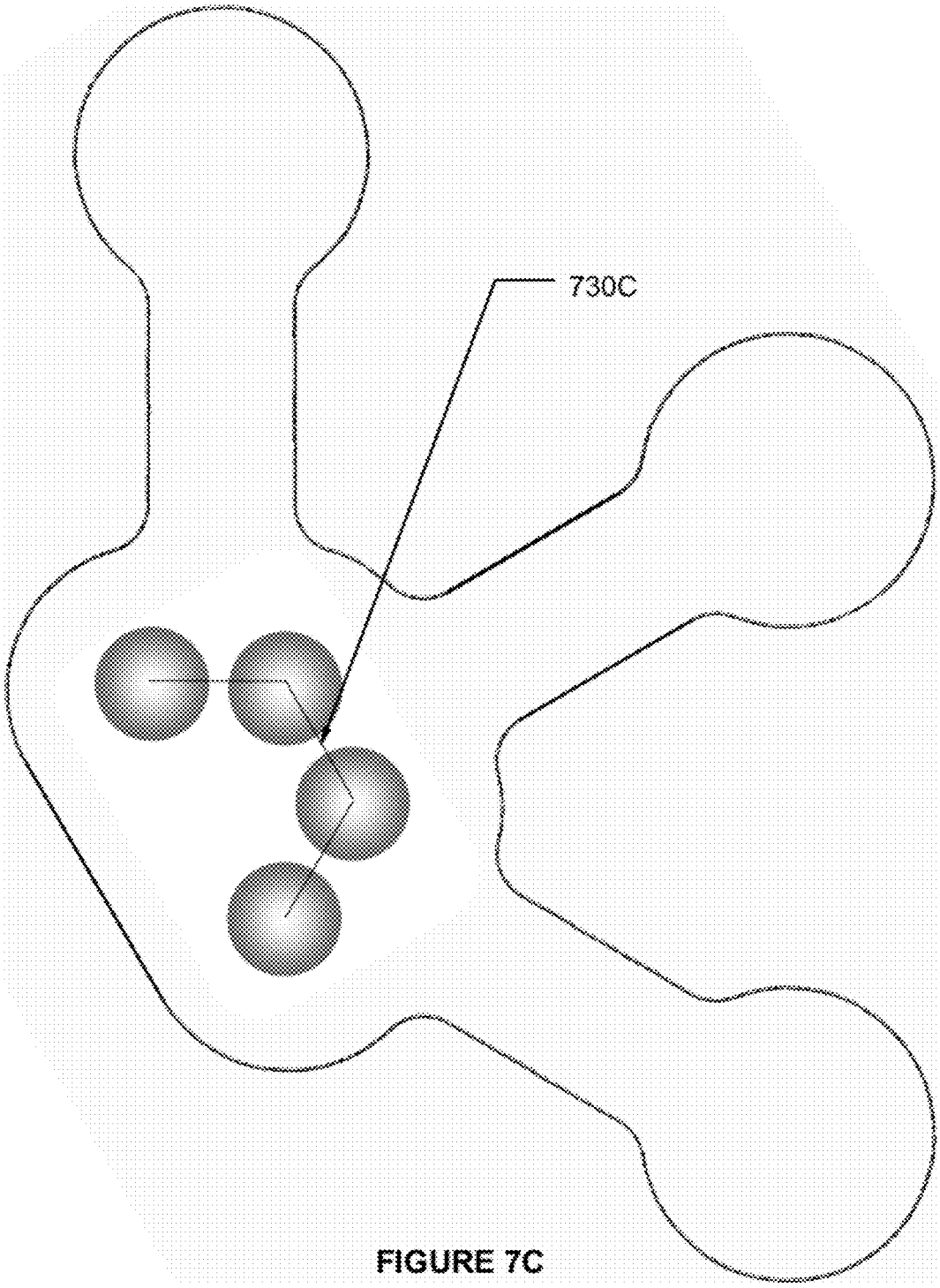
Figure 7D:
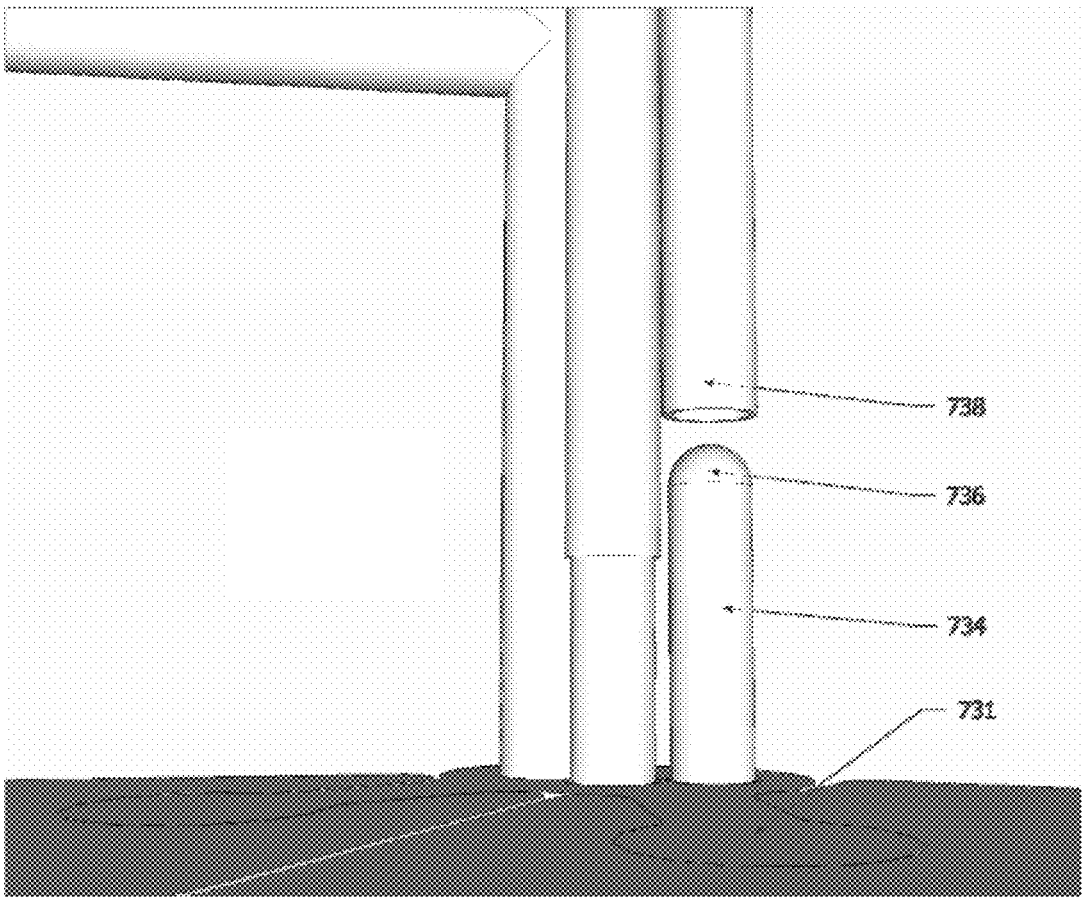
Figure 7E:
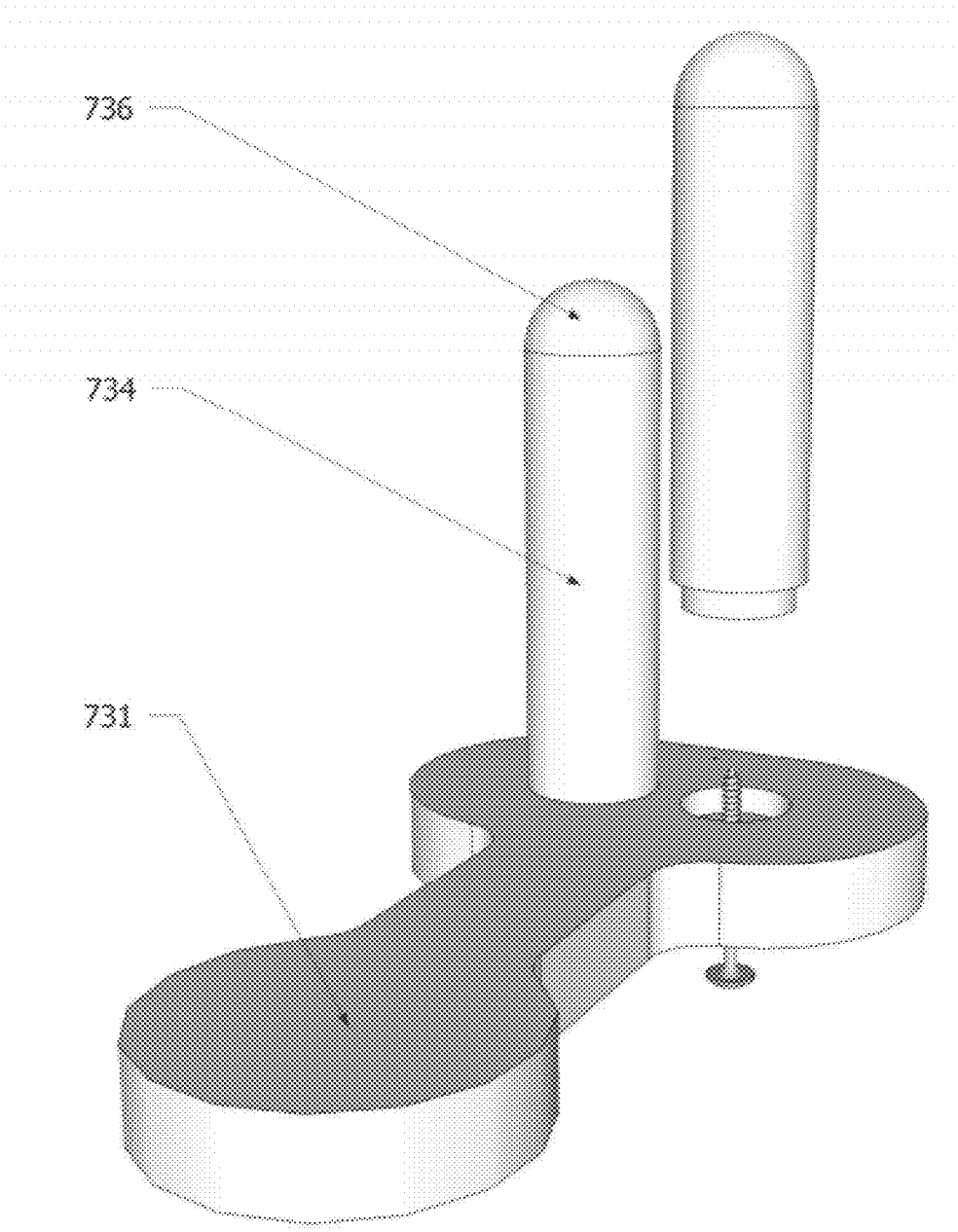

FIGS. 7A to 7E are cross-sectional views of the base connectors of the modular ladder frame assembly. The base connectors connect to stabilize the base of the modular ladder frame. FIGS. 7A, 7B and 7C illustrate cross-sectional top views of three embodiments of base connectors 730. The embodiment illustrated in FIG. 7A is a two aperture configuration 730A. The embodiment illustrated in FIG. 7B is a three aperture configuration 730B. The embodiment illustrated in FIG. 7C is a four aperture configuration 730C. FIG. 7D illustrates one embodiment of the base connector that comprises a bottom plate 731 and a tubular protuberance 734 with a round top 736 that fits into a hollow portion 738 of a modular ladder frame. FIG. 7E illustrates one embodiment of the base connector that comprises a bottom plate 731 and two tubular protuberances 734 with a round top 736 that fits into two hollow portions 738 of a modular ladder frame. FIG. 7E illustrates the rounded tops 736 on the tubular protuberances 734 that facilitate the assembly of the frames into composite towers by aligning the legs of the frames to the base connectors. In order to precisely establish the spacing of the tubular protuberances 734, and thereby the ladder frames, the tubular protuberances 734 are inset into recesses in the base connector. This arrangement of a stepped connection also adds strength and rigidity between the tubular protuberances 734 and the base connector.

Figure 8A:
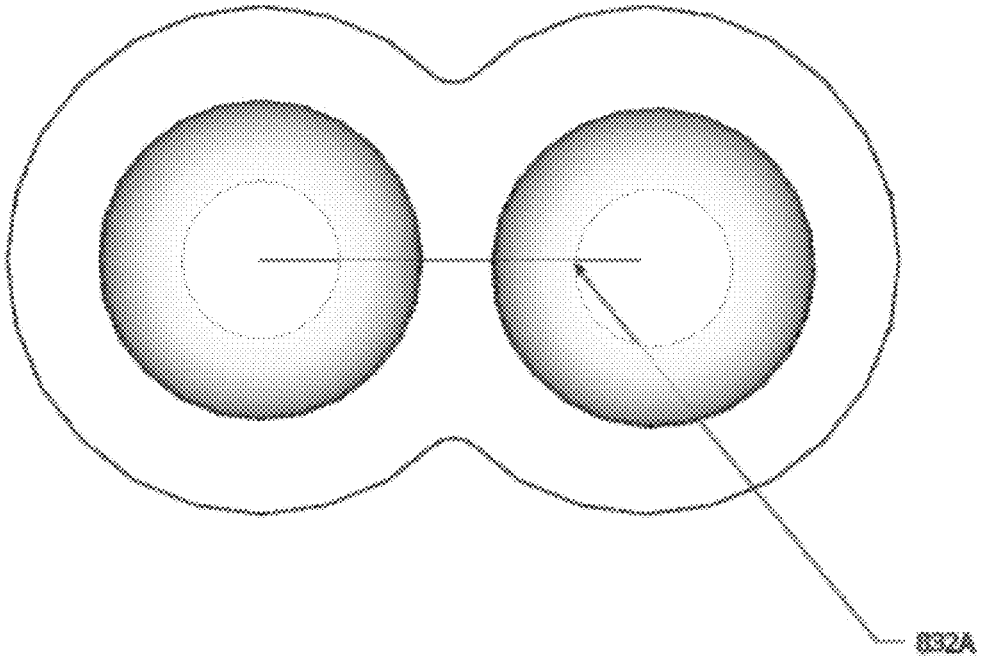
FIGS. 8A to 8E are cross-sectional views of the top connectors of the modular ladder frame assembly.
Figure 8B:
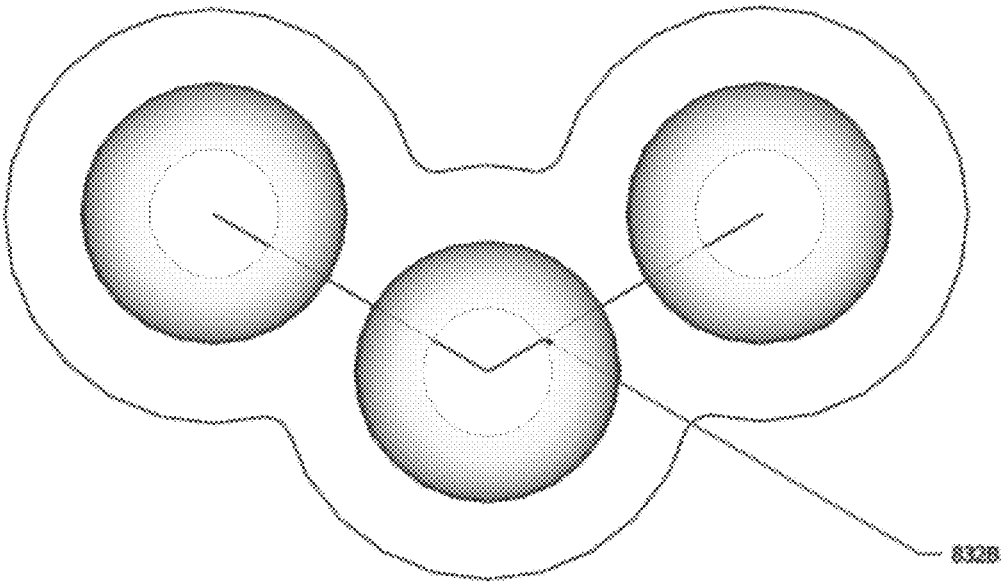
Figure 8C:
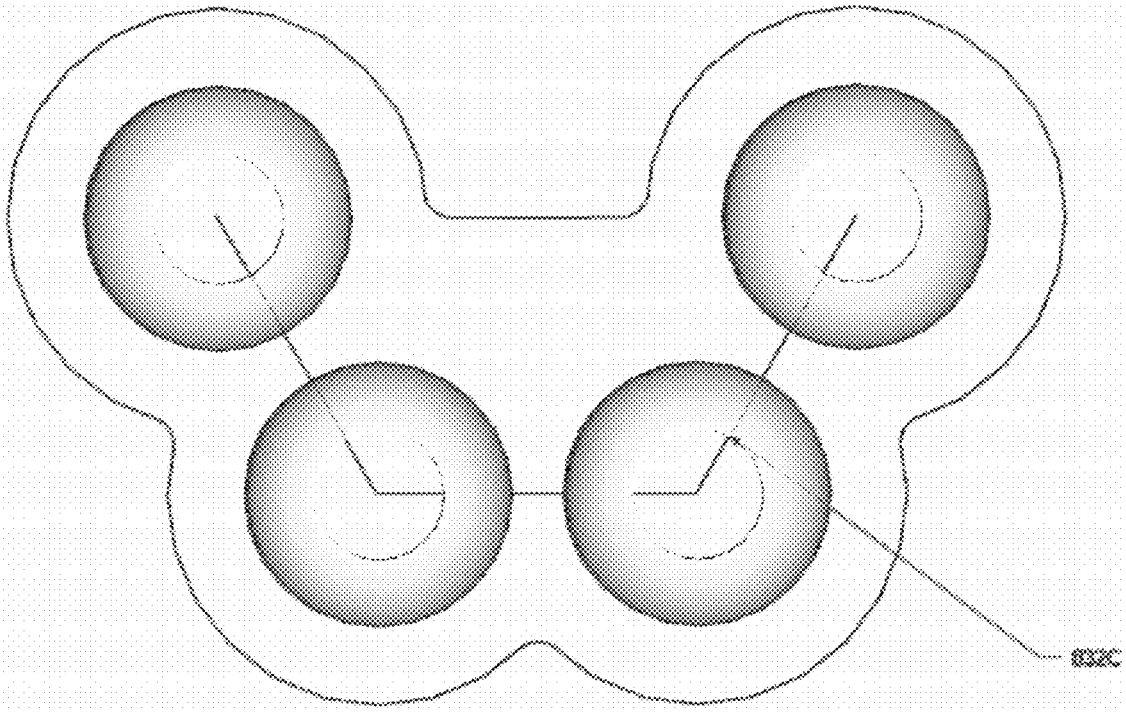
Figure 8D:
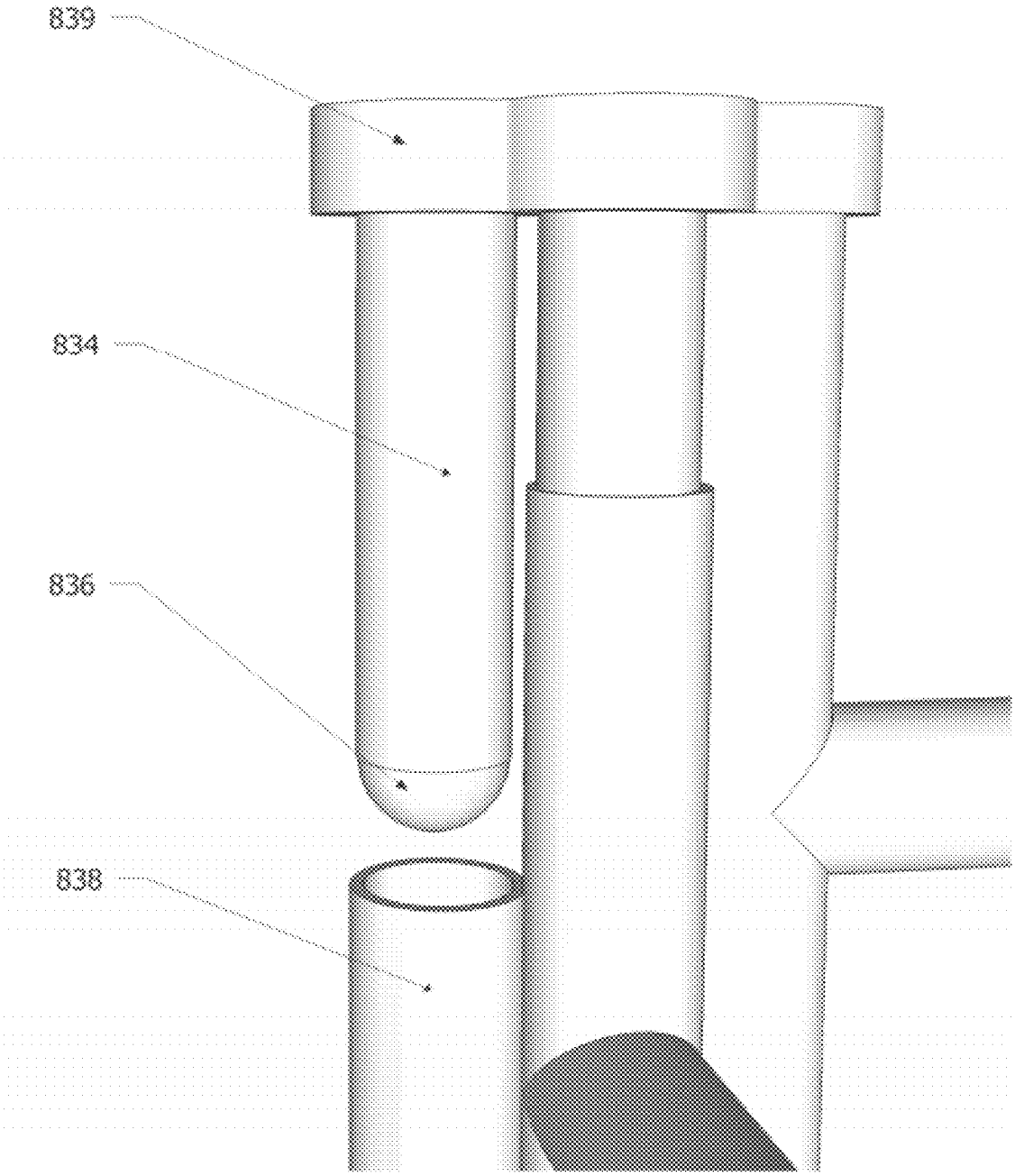
Figure 8E:
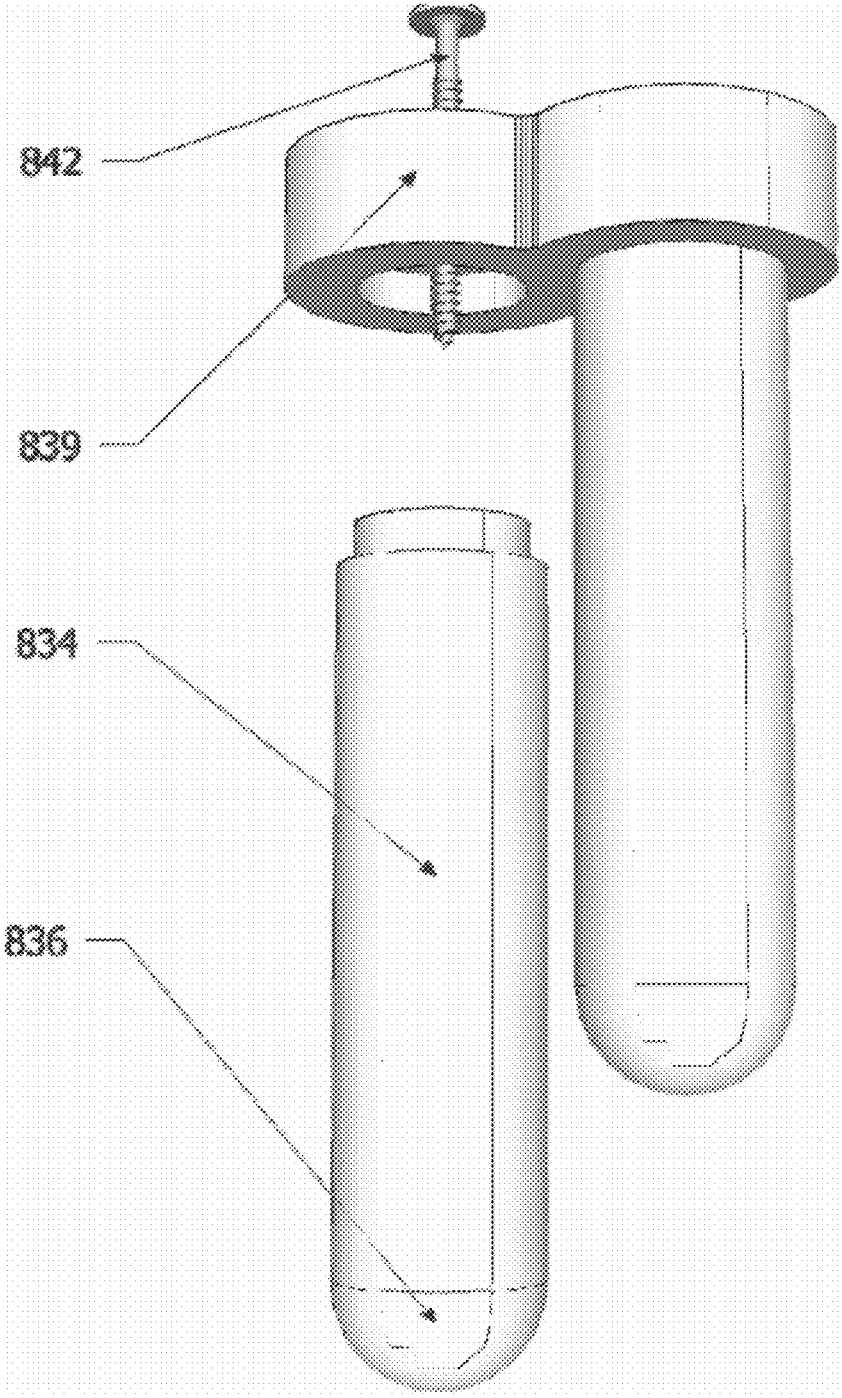

FIGS. 8A to 8E are various views of the top connectors of the modular ladder frame assembly. The top connectors connect to stabilize the top of the modular ladder frame. FIGS. 8A, 8B and 8C illustrate top views of three embodiments of top connectors 832. The embodiment illustrated in FIG. 8A is a two aperture configuration 832A. The embodiment illustrated in FIG. 8B is a three aperture configuration 832B. The embodiment illustrated in FIG. 8C is a four aperture configuration 832C. FIGS. 8D and 8E illustrate two side views of one embodiment of a two aperture top connector 832A. FIG. 8D illustrates one embodiment of a three aperture top connector 832B that comprises a top plate 839, ladder connecting tubular protuberances 834 and rounded end 836 that fits into a hollow portion 838 of a modular ladder Frame. FIG. 8E illustrates one embodiment of a two aperture top connector 832A that comprises a top plate 839, two ladder connecting tubular protuberances 834 with round end 836. In the embodiment shown in FIG. 8E, the internal connector 842 can be connected by any means known to one of ordinary skill in the art, such as by screwing or tapping.

Figure 9A:
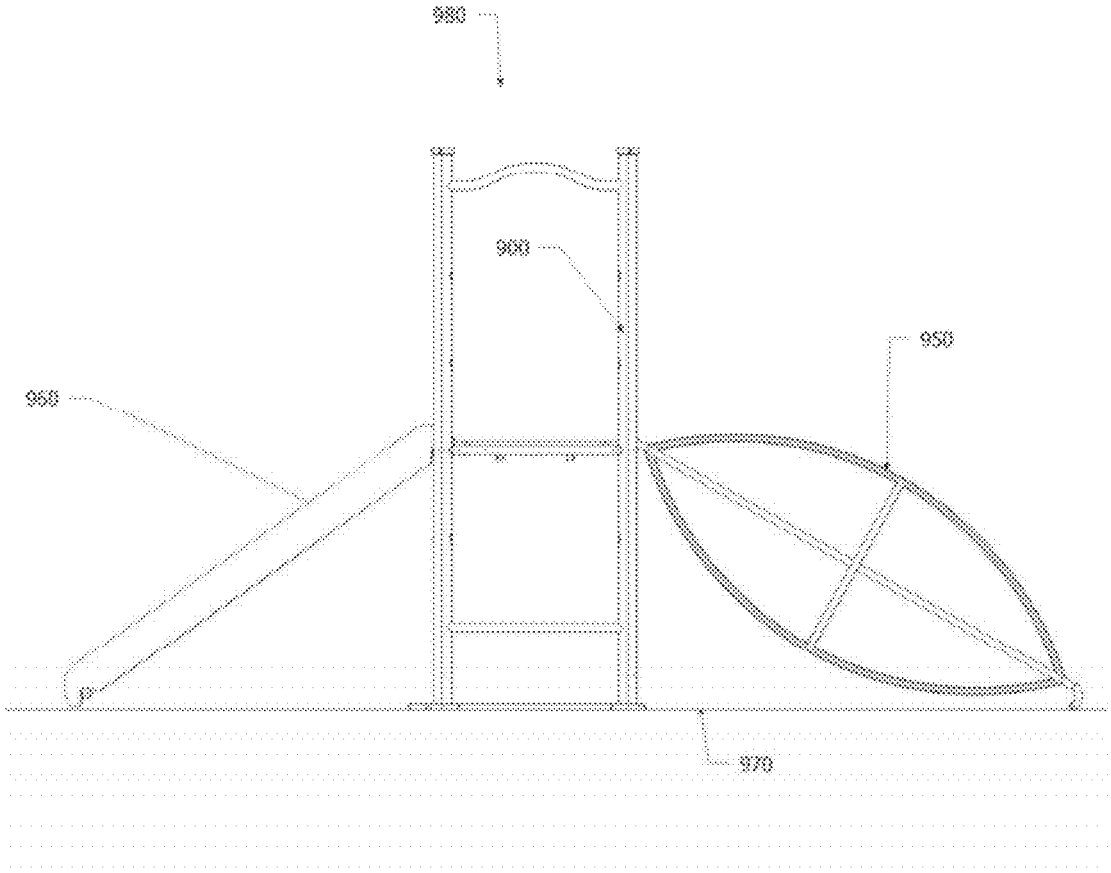
FIGS. 9A to 9C are detailed side views of two embodiments of the modular ladder frame assembly that comprises two embodiments of brace mechanisms.

FIG. 9A is a side view of one embodiment of the modular frame assembly playground system 980 of the present disclosure that comprises a modular ladder assembly 900 and two embodiments of brace mechanisms 950 and 960. While single towers made of three or more modular ladder frames, such as those illustrated in FIG. 1, are inherently stable for compression loads, additional stability is required for lateral loads. This is achieved by placing side brace mechanisms 950 and 960. In this example, shown in FIG. 9A, these brace mechanisms 950 and 960 are comprised of play equipment modules, such as climbers 950 and slides 960. The weight of play equipment modules is sufficient to stabilize the towers for most uses; however, additional stability is added when the modular ladder frame playground system 980 is installed on a nonskid surface, 970 which tends to prevent the braces from sliding away from the towers.

Figure 9B:
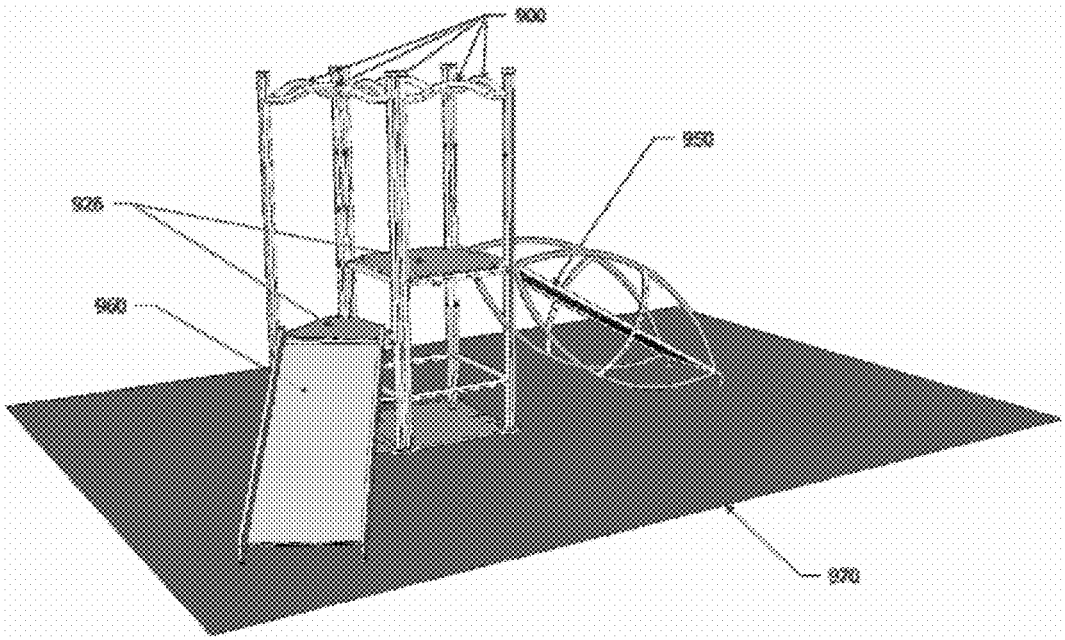

FIG. 9B is a 3-D side view of one embodiment of the modular frame assembly playground system 980 of the present disclosure that comprises a modular ladder frame assembly 900 and two embodiments of the brace mechanisms 950 and 960. In this example, shown in FIG. 9B, the modular ladder frame 900 comprises a brace mechanism 960 or slide and a climber 950 and two lockable decks 926 installed on a nonskid surface 970, which tends to prevent the braces from sliding away from the towers.

Figure 9C:
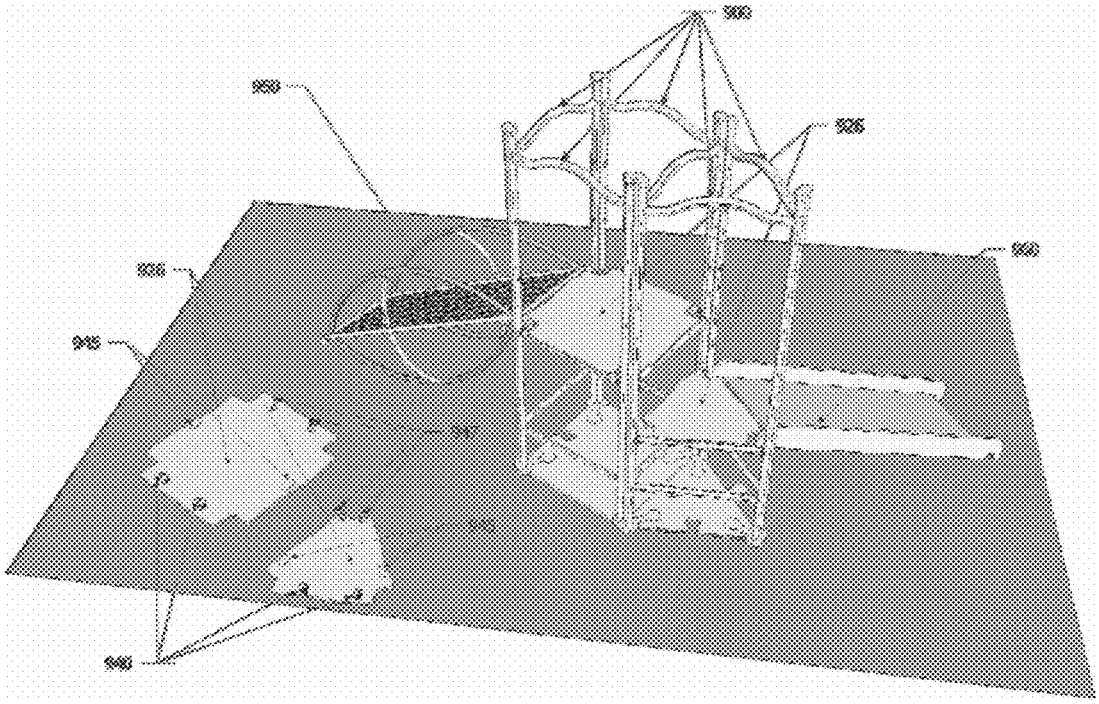

FIG. 9C is a 3-D side view of one embodiment of the modular frame assembly playground system 980 of the present disclosure that comprises a modular ladder frame assembly 900 and one embodiment of the brace mechanism 960, a slide. In this example, shown in FIG. 9C, the modular ladder frame assembly 900 comprises brace mechanisms 960 or slide and 950, climber lockable decks 926 installed on a nonskid surface 970, which tends to prevent the braces from sliding away from the towers. The lockable decks 926 shown are both a triangular and a square or cross shape; however, one skilled in the art understands that many geometric shapes are possible. The two lockable decks 926 are shown twice in the figure, once as attached to the modular frame assembly 900 and once as separated from the modular frame assembly with the underside exposed. The lockable decks 926 with the underside sides exposed show cleats 945 and hooks 940 and lockable deck latches 947. As described above, in FIGS. 6A to 6E, lockable decks 926 are inserted between these modular ladder frames 900, which, by virtue of having cleats 945 and hooks 940 and lockable deck latches 947 or other spring-like elements on its edges, force the cleats 945 and lockable deck latch 947 to lock into place.

Figure 10A:
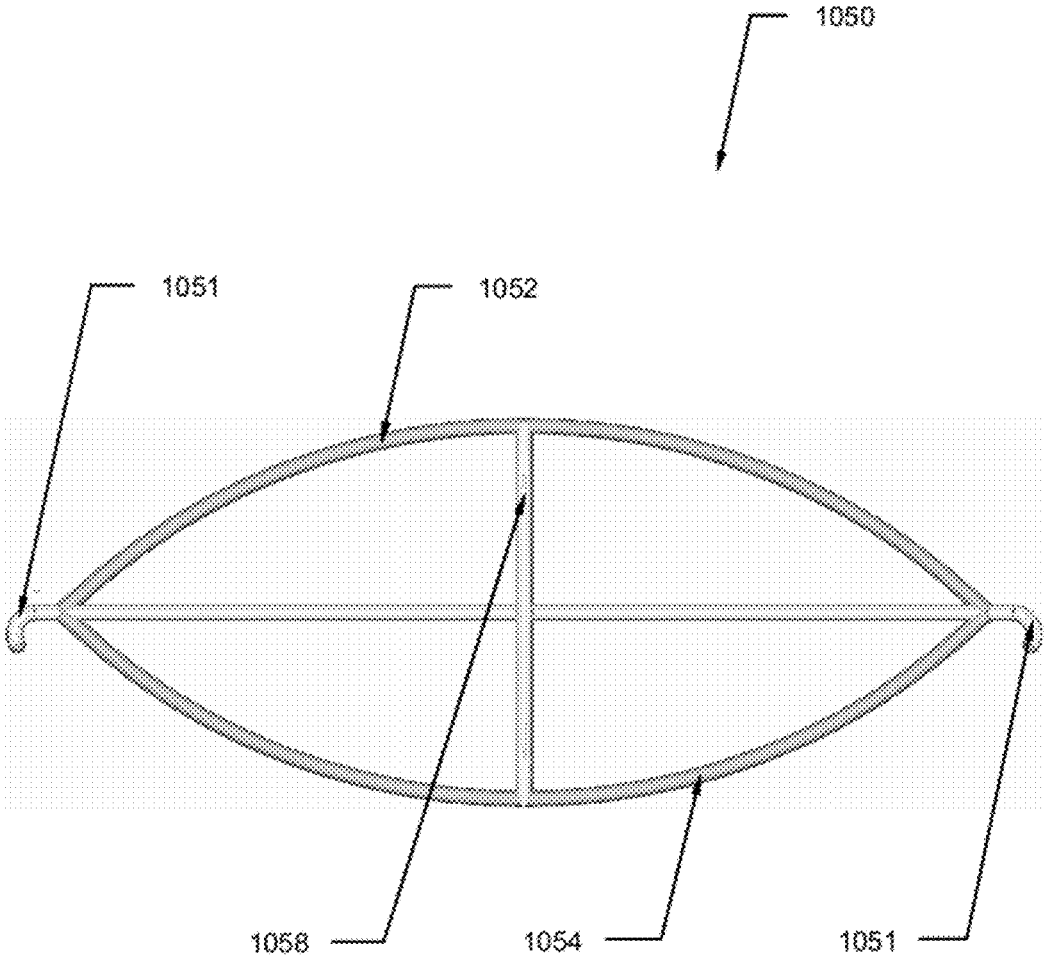
FIGS. 10A and 10B illustrate side views of one embodiment of the brace of the modular frame assembly playground equipment system.
Figure 10B:
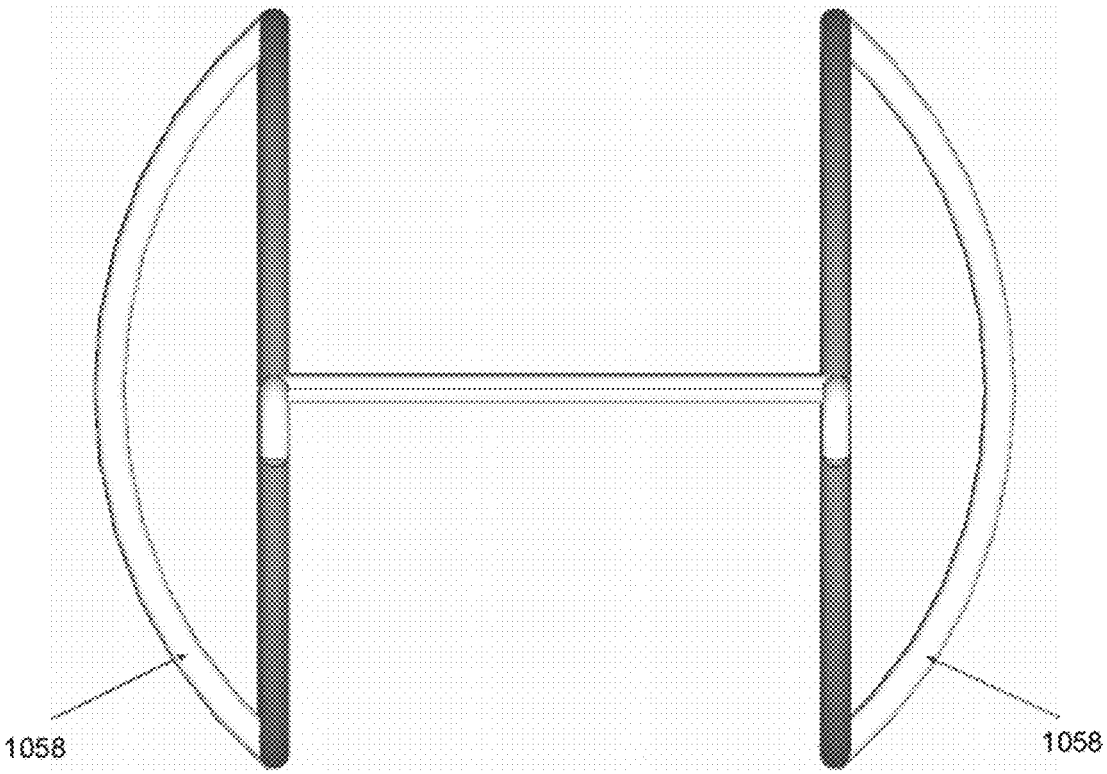
Figure 10C:
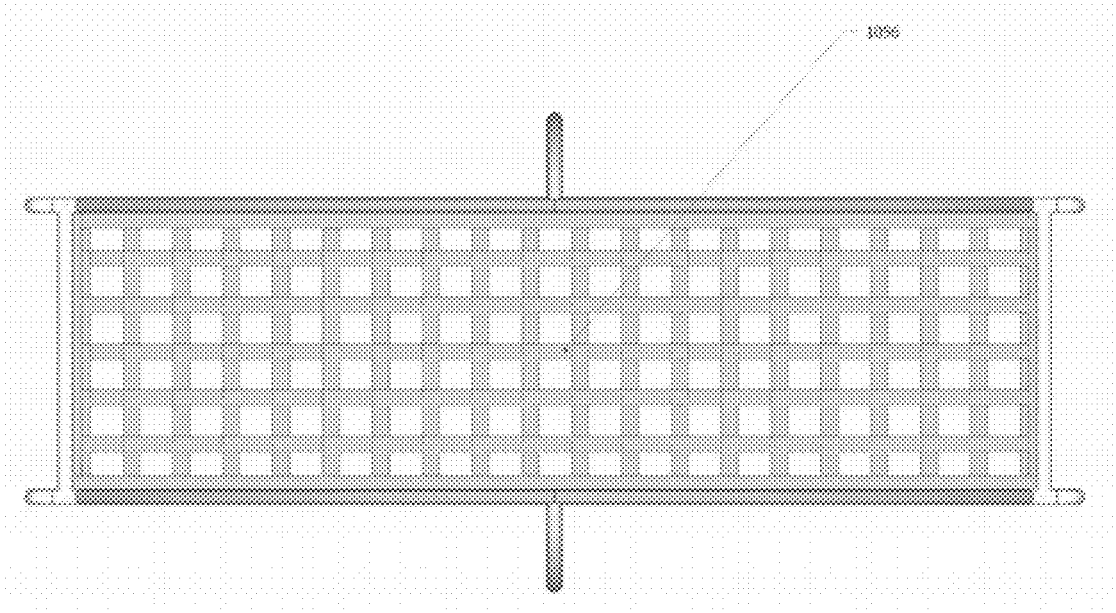
FIG. 10C illustrates a perspective view of the center frame of one embodiment of a brace mechanism.

FIGS. 10A, 10B and 10C illustrate one embodiment of a brace mechanisms 1050—a rocking climber. Other brace mechanisms may comprise various playground equipment modules, including, but not limited to, stairways, ladders, slides, fish-eye windows, safety rails, game devices, tunnels, walkways and the like. FIGS. 10A and 10B illustrate side views of one embodiment of the brace mechanisms 1050 of the modular frame playground system 980. The embodiment in FIGS. 10A illustrates the hooks 1051, the top arch rail 1052, the bottom arch rail 1054 and the side arch rail 1058 of the rocking climber embodiment. The embodiment in FIG. 10B illustrates a view of the side arch railing 1058. FIG. 10C illustrates the center portion 1056 attached to the railings.

FIG. 10C illustrates a perspective view of the center portion 1056 of one embodiment of a brace mechanism 1050. The center portion 1056 may comprise various embodiments of climbing structures. In this example, the center portion 1056 is a fitted net, but any number of other climbing opportunities, such as rungs could be used.

The rocking climber brace mechanism shown in FIG. 10A-C, 1050 illustrates the synergy between various brace mechanisms and the ladder frame. The central idea of the rocking climber 1050 is, in addition to bracing the ladder frame, to provides a means of access to the decks at all of their various elevations. See FIGS. 9A-9C. Since rocking climber brace mechanism 1050 must accommodate a wide variety of ages, hooks 1051 are provided at either end which not only secure the rocking climber brace mechanism 1050 in place but also provide stability to the system by triangulating between the removable rung on which it rests and the nonskid floor. Because of the ability of the system to be rapidly reconfigured for a wide variety of play experiences the rocking climber brace mechanism 1050 may also be used at ground level. Repeating the top arch rail 1052 on the opposite side, the bottom side rail 1054 now allows the device to function as a rocker on the floor. In addition to rocking the device can also be spun around.

Since younger children need stability support while climbing, a top arch rail 1052 is provided comprising an arch shape so that it readily falls to the hand in all possible orientations. The top arch rail 1052 and bottom arch rail 1054 require structural rigidity and an another outside arch rail arch 1058 is placed on the outside of the rocking climber 1050 on both sides. These small outside arches 1058 also serve to prevent the railing arches from collapsing should pressure, such as sitting, be applied to them since, should such pressure be encountered, the device rolls out of harm's way.

Figure 11:
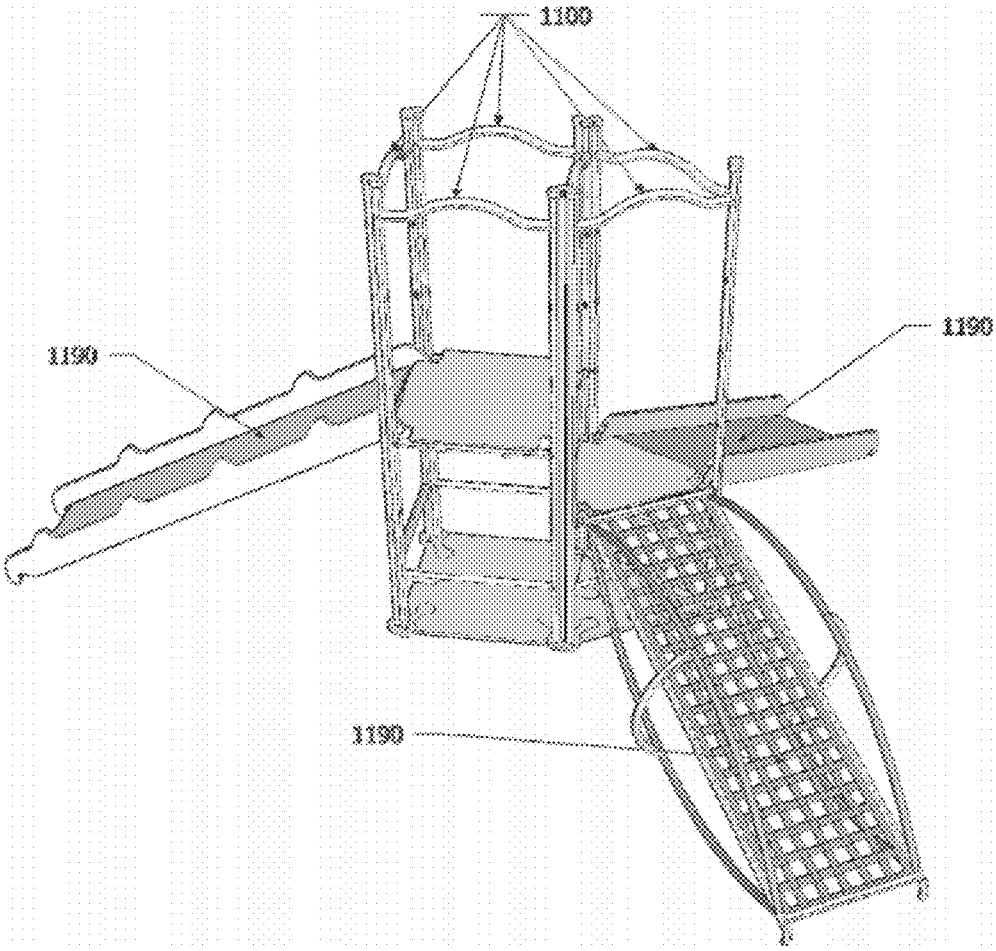
FIG. 11 is a perspective view of an assembled modular ladder frame playground system showing playground equipment modules attached to the modular assembly and brace mechanism illustrated in FIGS. 1-10.

FIG. 11 is a perspective view of an assembled modular ladder frame playground system showing playground equipment modules attached to the modular ladder frame assembly mechanism 1100 and three brace mechanisms 1190, illustrated in FIGS. 1-10. The three brace mechanisms 1190 are two embodiments of a climbing structure and a slide connected to the modular ladder frame assembly mechanism 1100. In the system of the present disclosure, each additional component adds cumulatively to its stability of the overall system. The three or more modular ladder frames with top and bottom connectors make a frame that will stand on its own. By inserting the lockable deck with the top connectors, the stability of the system increases. Placing the brace mechanisms on the modular ladder frame assembly adds heft to the system and braces the towers. Thus, a completed modular ladder frame playground system is a very stable structure composed of separate components that are mutually dependent.

Figure 12:
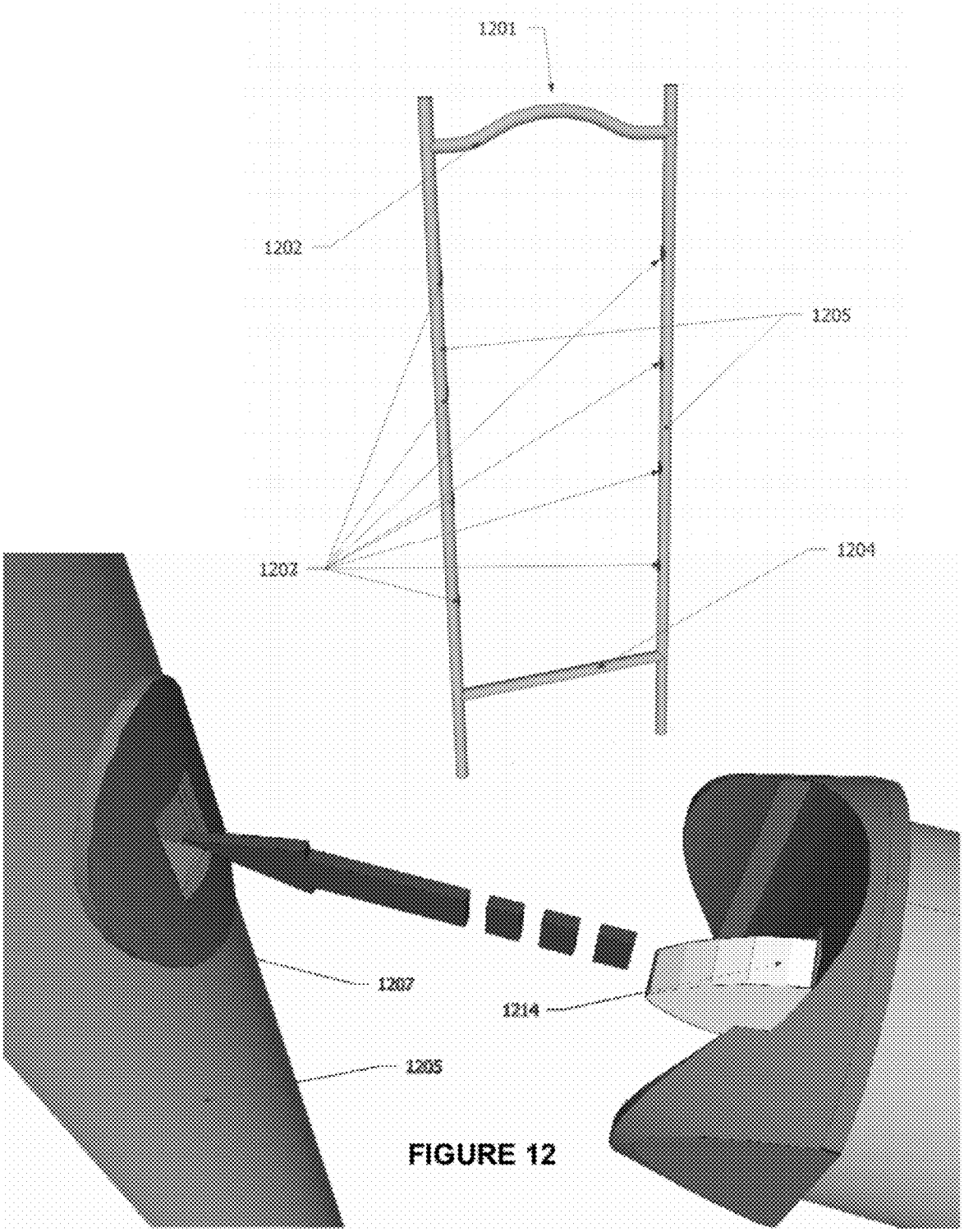
FIG. 12 is an illustration of the ladder frame assembly of the present disclosure.
Figure 13:
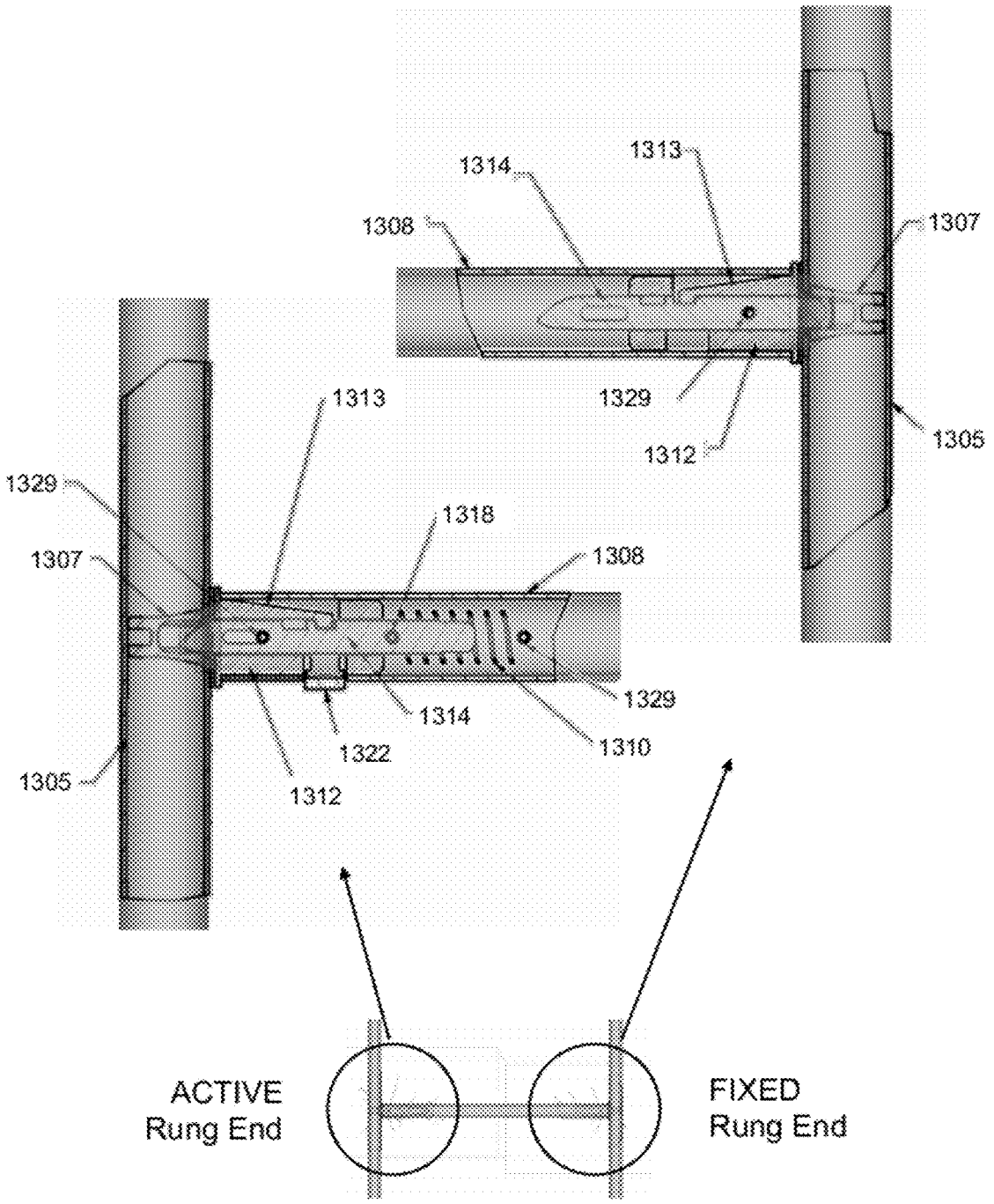
FIG. 13 is an illustration of the removable rung assembly of the present disclosure.

The Ladder with Removable Rungs consists of two basic sub-assemblies, the Ladder Frame Assembly (See FIG. 12) and the Removable Rung Assembly (See FIG. 13). In an exemplary embodiment, the Ladder Frame Assembly 1201 consists of a frame (See FIG. 12) composed of two Tubular Ladder Pipe Segments 1205 and one Upper Fixed Rung 1202, and one Lower Fixed Rung 1204, that are permanently affixed to one another, and also includes 8 Receiver Cups 1207 that are captured in holes drilled in the Tubular Ladder Pipe Segments 1205 by means of a built-in catch in the Receiver Cups 1207, four Receiver Cups 1207 per Tubular Ladder Pipe Segment 1205, and positioned so that they are directly adjacent to one another, and facing one another. Each Receiver Cup 1207 also has a rectangular slot passing partway through its center axis, transverse to the long axis of the Tubular Ladder Pipe Segments 1205, having its long axis parallel to the long axis of the Tubular Ladder Pipe Segments 1205, for the purpose of admitting the Latch Bar 1214. This slot intersects with a rectangular slot of the receiving cup 1207 that runs perpendicular to the rectangular slot, thereby securing the Removable Rung Assembly to the Ladder Frame Assembly.

A related assembly, the Removable Rung Assembly (See FIG. 13), is fitted to Ladder Frame 1305, which is fitted with Receiving Cups 1307 at each rung location [along] its length, in an exemplary embodiment, is constructed of a Tubular Rung Segment 1308 having three small Holes near one end, and one Hole near the other end, which are all aligned along a tangent line that is positioned on the outer Tubular Rung Segment 1308 diameter, and is parallel to the longitudinal axis of the Tubular Rung Segment 1308. The Holes at the first end allow a special adapter, the Sleevie Wonder 1312. The Sleevie Wonder 1312 comprises a flange to stop it in the pipe during assembly and a Rectangular Hole at the flanged end to admit the Latch Bar 1314 to be slipped inside the slotted end of the Tubular Rung Segment 1308.

A Latch Bar 1314 is then slipped into the Rectangular Hole in the end of the Sleevie Wonder 1312. The Latch Bar 1314 has two notches in its upper side to secure the bar in either its open or closed positions. A Release Button 1322 that has one side relieved to match the radius of the Tubular Rung Segment 1308, and a hollow area molded into its body is secured to the Latch Bar 1314 by expanding this opening so that it may pass the Latch Bar 1314 and spring back to be held securely by the body of the Sleevie wonder 1312. The Sleevie Wonder 1312 is secured with a pin 1329 through a slot in the Latch Bar 1314 that is nearest the arrow point end, securing the Latch Bar 1314 to the rest of the assembly such that it may be released to slide along the slot by means of the Release Button 1322 and spring 1310, and by that means be either fully extended or fully retracted by hand. Once released by the Release Button 1322 the Latch Bar 1314 is locked in position by the Catch Lever 1313 that is integral with the Sleevie Wonder 1312. The other end of the Removable Rung Assembly is completed having the second Sleevie Wonder 1312, positioned so that it is parallel to the first Sleevie Wonder 1312. The second Latch Bar and the second Sleevie Wonder 1312 are secured to the Tubular Rung Segment 1308 using a pin that passes through the Tubular Rung Segment 1308, through the Sleevie Wonder 1312, and through the hole in the Latch Bar 1314 thereby forming the "Fixed" Latch Bar 1314 end of the Removable Rung Segment Assembly.

Figure 14:
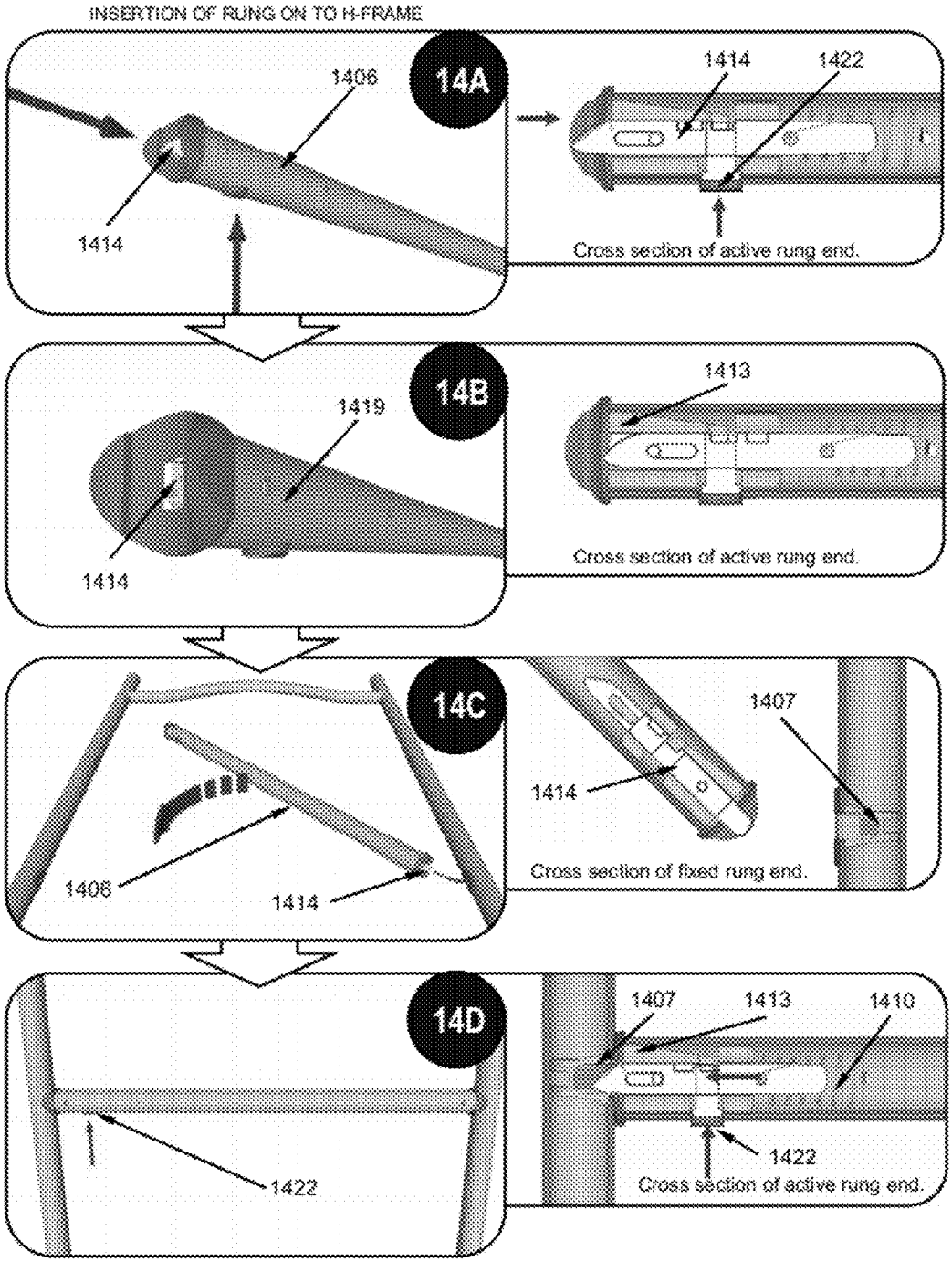
FIGS. 14A-F is an illustration of the assembly and removal of the rungs from the ladder frame of the present disclosure.
Figure 14:
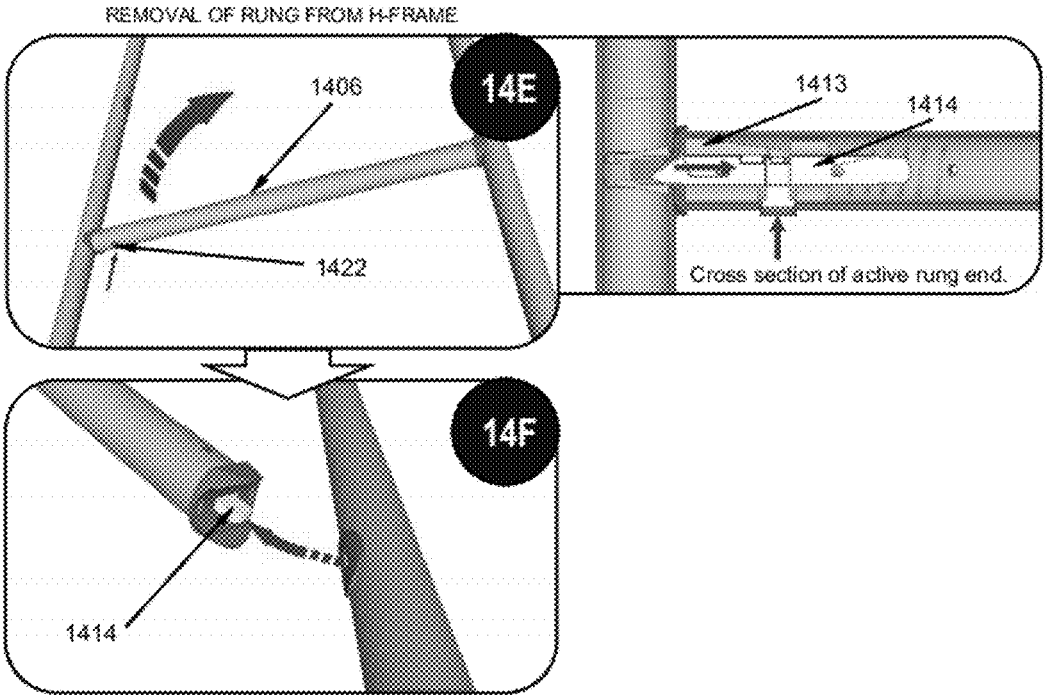

To assemble a Removable Rung Segment 1406 Assembly to a Ladder Frame Assembly (See FIG. 14), a Removable Rung Segment Assembly having its retractable Latch Bar 1414 is prepared by manually depressing the Latch Bar 1414 into the fully retracted position while simultaneously depressing the Release Button 1422 which is then held by a Catch Bar 1413 that intersects with a notch in the Latch Bar 1414 (see FIGS. 14A and B). The fixed Latch bar 1414 (see FIG. 14C) is then inserted fully into any of the Receiver Cups 1407, allowing the other end—having the retractable Latch Bar 1414 still fully retracted—to be rested in the slot portion of any opposite Receiver Cup 1407. Next the retracted Latch Bar 1414 is allowed to extend fully into the Receiver Cup 1407 by the force of the Spring 1410 by again depressing the Release Button 1422, aligning its arrow-shaped end to align with the rectangular slot inside of the Receiver Cup 1407. Now the Removable Rung Segment Assembly is be "locked" into position by the Catch Lever 1413 (see FIG. 14D) on the body of the Sleevie Wonder.

A Removable Rung Segment Assembly may be removed from a Ladder Frame Assembly (see FIGS. 14E and F) by pressing the Release Button 1422 and the arrow shaped point of the Latch Bar 1414 is depressed by the action of lifting the Removable Rung and the Latch Bar 1414 is held in its retracted position by the second notch on the Latch Bar 1414.

All documents cited in the Detailed Description are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the scope of the invention. It is therefore intended to cover in the appended claims all such changes and modifications that are within the use.

The invention claimed is:

1. A module assembly system for connection of a variety of playground equipment modules comprising:

three or more modular ladder frames;

a plurality of connectors connecting the three or more modular ladder frames;

a lockable deck connected to the three or more modular ladder frames and the plurality of connectors;

a floor puzzle that receives at least one of the plurality of connectors to support the module assembly system; and wherein each of the three or more modular ladder frames comprises one or more removable rungs, wherein the one or more removable rungs are removably coupled between a pair of vertical supports.

2. The system of claim 1, wherein each of the three or more modular ladder frames comprises:

a fixed top rung connecting the pair of vertical supports in a top region or the pair of vertical supports; and a fixed bottom rung connecting the pair of vertical supports in a bottom region of the pair of vertical supports.

3. The system of claim 1, wherein the lockable deck is removably coupled with the one or more removable rungs.

4. The system of claim 1, wherein the lockable deck comprises:

one or more latches configured to engage one or more of the three or more modular ladder frames; and one or more hooks configured to engage one or more o the three or more modular ladder frames.

5. The system of claim 1, wherein the plurality of connectors comprises bottom connectors connecting a bottom region of the three or more modular ladder frames.

6. The system of claim 1, wherein the plurality of connectors comprises top connectors connecting a top region of the three or more modular ladder frames.

7. The system of claim 1, wherein the plurality of connectors comprises: a plurality of bottom connectors connecting a bottom region of the three or more modular ladder frames; and a plurality of top connectors connecting a top region of the three or more modular ladder frames.

8. The system of claim 1, wherein one or more of the plurality of connectors is configured to receive two of the three or more modular ladder frames.

9. The system of claim 1, wherein one or more of the plurality of connectors is configured to receive there of the three or more modular ladder frames.

10. The system of claim 1, wherein one or more of the plurality of connectors is configured to receive four of the three or more modular ladder frames.

11. The system of claim 1, wherein the plurality of connectors comprises two or more tubular protuberances, wherein the two or more tubular protuberances are configured to engage one or more of the three or more modular ladder frames.

12. The system of claim 11, wherein the two or more tubular protuberances are configured to receive a hollow portion of one or more of the three or more modular ladder frames.

13. The system of claim 1, further comprising one or more brace mechanisms connected to the modular ladder frame assembly.

14. The system of claim 13, wherein the one or more brace mechanisms are selected from the group consisting of a rocking climber, a slide, a stairway, a ladder, a fish-eye window, safety rail, game device, tunnel, and walkway.

* * * * *